US006684419B1

(12) United States Patent
Perla

(10) Patent No.: US 6,684,419 B1
(45) Date of Patent: Feb. 3, 2004

(54) BEDSIDE LOWER EXTREMITY LIFTING APPARATUS

(76) Inventor: Frank W. Perla, 1623 W. 2100 North, Helper, UT (US) 84526

( * ) Notice: Subject to any disclaimer, the term of this patent is extended or adjusted under 35 U.S.C. 154(b) by 0 days.

(21) Appl. No.: 10/042,864

(22) Filed: Jan. 8, 2002

(51) Int. Cl.[7] ..... A61G 7/053

(52) U.S. Cl. ..... 5/81.1 R; 5/624; 5/648; 5/658

(58) Field of Search ..... 5/81.1 R, 81.1 RP, 5/648, 507, 624, 181, 186, 661, 662, 503.1, 658

(56) References Cited

U.S. PATENT DOCUMENTS

| | | | | |
|---|---|---|---|---|
| 1,749,867 A | * | 3/1930 | Allison | 5/618 |
| 3,327,328 A | * | 6/1967 | Silvoski | 5/661 |
| 3,806,194 A | * | 4/1974 | Kolebaba | 297/344.19 |
| 4,584,731 A | * | 4/1986 | Carter | 5/632 |
| 4,797,960 A | | 1/1989 | Vaiana et al. | |
| 4,969,221 A | * | 11/1990 | Foster | 5/81.1 R |
| 5,033,793 A | | 7/1991 | Quintile | |
| 5,046,206 A | * | 9/1991 | Broyles | 5/646 |
| 5,319,817 A | | 6/1994 | Hay et al. | |
| 5,323,498 A | | 6/1994 | Fellay et al. | |
| 5,619,762 A | | 4/1997 | Mein | |
| 5,682,630 A | | 11/1997 | Simon | |
| 5,906,415 A | * | 5/1999 | Mocur | 297/423.3 |
| 5,916,085 A | | 6/1999 | Wells | |
| 6,026,523 A | | 2/2000 | Simon et al. | |
| 2001/0008028 A1 | | 7/2001 | Blevins | |

FOREIGN PATENT DOCUMENTS

| | | |
|---|---|---|
| EP | 0 547 195 B1 | 1/1996 |
| JP | 07016263 A | 1/1995 |
| JP | 07213564 A | 8/1995 |
| JP | 8-280744 A | 10/1996 |
| JP | 10-295744 A | 11/1998 |

* cited by examiner

*Primary Examiner*—Michael F. Trettel
(74) *Attorney, Agent, or Firm*—Morriss O'Bryant Compagni, P.C.

(57) ABSTRACT

A bedside lower extremity lifting apparatus is comprised of a support frame coupled to a platform. The support platform can be selectively raised and lowered by an actuator assembly coupled between the support frame and the platform. The lifting apparatus is configured to be positioned adjacent a conventional patient support structure such as a mattress-type bed or patient table and can be properly used and operated in conjunction with the bed with or without modification thereto. When the platform is in its lowered position, the platform and support frame have a relatively low profile so as to allow a user to comfortably sit on the edge of the bed. A user control is provided to allow the user to selectively raise and lower the platform as desired. By sitting on the edge of the bed and raising the platform to a sufficiently elevated position, the user is able to raise his or her legs to a height that allows the user to more comfortably maneuver their legs onto the bed.

84 Claims, 22 Drawing Sheets

BEDSIDE LOWER EXTREMITY LIFTING APPARATUS

BACKGROUND

1. Field of the Invention

The present invention relates generally to patient lifting devices and, more particularly, to a patient lifting device that assists a patient into and out of a bed or other patient supporting device by supporting the lower extremities of the patient. The device is configured to be positioned next to a bed and assist the patient into the bed by lifting the lower extremities to a horizontal position so that the patient can maneuver his or her legs onto the bed along a horizontal surface.

2. Description of the Prior Art

Many patients and persons have difficulty lifting their legs onto a bed or other support surface such as a treatment table in a doctor's office, care facility or hospital room from a bedside position without assistance. For example, those whose leg muscles have been weakened due to advanced age or who have lost the complete or partial use of their legs due to paralysis, illness or injury often require some assistance to get into bed. In addition, other injuries of the back, hip or surgery involving the back or hip can result in limited mobility of the legs and the inability of the patient to lift their legs into bed.

In most cases, individuals suffering from the foregoing ailments require the presence of another individual in order to be able to get into bed or onto a treatment table without further injuring themselves, either by falling or by straining muscles, ligaments and the like. In cases involving surgery, such lifting of the legs without assistance is extremely painful. For those individuals who find that they cannot get themselves into bed without assistance and are not being cared for at a care facility where medical staff is readily available, such individuals often must pay for special assistance or rely on family and friends. Where the individual is at home, for example, around the clock support is required to help the individual back into bed each time the individual returns to bed.

Various lifting devices are provided in the art that are provided to assist a patient onto a bed or lift them relative to the bed once they are already positioned on the bed. For example, U.S. patent application Ser. No. 09/796,368 published on Jul. 19, 2001, provides a cantilevered mobile bed/chair apparatus for safely transferring a patient from and to a hospital type bed comprising three hinged together segments forming back, seat and foot platforms operating in conjunction with a four wheeled rectangular base. The device, however, is a complex apparatus that requires separately articulating surfaces.

U.S. Pat. No. 6,026,523 issued Feb. 22, 2000, provides a portable lifting apparatus for lifting and transferring of patients for use in combination with a sling or the like support. Separate motors are required for control of up and down movement of the lifting arm, clockwise and counter clockwise rotation of the column, extension and retraction of each of the legs individually and divergence and convergence of both legs simultaneously. Such a device, however, is configured to lift the entire person and is a complex arrangement of components.

Likewise, U.S. Pat. No. 5,682,630 issued on Nov. 4, 1997 is a boom-like apparatus for lifting and transferring of patients for use in combination with a sling or the like support. Again, such a device is a complex configuration for lifting the entire body of a patient and not well suited for easy bedside use.

U.S. Pat. No. 5,323,498 issued on Jun. 28, 1994, discloses a collapsible bedridden patient handling aid essentially consisting of a lifting device comprising a frame mounted on two pairs of wheels combined with retractable legs and supporting a platform designed to be inserted between the patient and the bed to raise the patient and put him or her back down, the platform consisting of moveable flat strips mounted individually on a support which is pivotable about a horizontal axis. Thus, the device is configured to lift the entire patient above the bed, as may be desired to change the bedding or transfer the patient to another bed, but is not configured to assist the patient into the bed.

U.S. Pat. No. 5,033,793 issued on Jul. 23, 1991, provides an extendable elevating leg rest for a wheelchair, but such a device is not configured for use with a conventional bed. Similarly, U.S. Pat. No. 4,797,960 issued on Jan. 17, 1989 discloses a wheelchair/bed arrangement requiring a complex wheelchair configuration and associated modification of the bed for proper operation.

Thus, it would be advantageous to provide a self-contained patient assist device for use with a conventional bed that does not require modification of the bed and that is configured for lifting of the lower extremities of a patient to a level that is sufficient for the user to then be able to maneuver their legs into the bed while sitting, leaning, or as they begin assuming a laying position on the bed.

SUMMARY OF THE INVENTION

These and other advantages will become apparent from a reading of the following summary of the invention and description of the illustrated embodiments in accordance with the principles of the present invention.

Accordingly, a bedside lower extremity lifting apparatus is comprised of a support frame coupled to a platform. The support platform can be selectively raised and lowered by an actuator assembly coupled between the support frame and the platform. That is, the platform can be raised and lowered in a hinge-type fashion or by raising and lowering a platform that stays in a relatively horizontal position throughout. The lifting apparatus is configured to be positioned adjacent a conventional mattress-type bed and can be properly used and operated in conjunction with the bed without modification to the bed.

When the platform is in its lowered position, the platform and support frame have a relatively low profile so as to allow a user to sit on the edge of the bed with the platform comfortably positioned between the user's legs and the bed mattress. A user control is provided to allow the user to selectively raise and lower the platform as desired. By sitting on the edge of the bed and raising the platform to a horizontal position, the user is able to raise his or her legs to a corresponding horizontal position. Once the user's legs reach a horizontal position or a sufficient height, depending on user comfort or ability, the user is then able to more easily maneuver their legs onto the bed.

The height of the pivot point of the platform is configured to be slightly below the height of the mattress. In that way, the user can comfortably sit on the edge of the bed with the platform in its lowered position with the weight of their body compressing the mattress and the upper edge of the platform will be at approximately the height of the compressed mattress. The height of the frame can be configured to be adjustable to allow the platform to be adjusted to the proper height for a given mattress. Likewise, the frame could be provided in several different sizes so as to allow the selection of a particular frame size depending upon the height of a given mattress.

The platform has a height when it is in a horizontal position that is substantially the height of the bed, allowing for clearance above the floor or base of the apparatus as well as height adjustability of the apparatus for use with various bed mattress heights. The width of the platform is configured to be sufficiently wide so as to allow the user to maneuver their legs about the upper surface of the platform while being substantially fully supported by the platform. The platform is provided with a padded surface to increase user comforted but may also comprise an unpadded surface formed from a sheet of smooth plastic, wood other material. In either case, the surface of the platform should have a relatively slick surface to facilitate the user in sliding their legs from the platform to the bed.

In one embodiment, a hydraulic or gear driven, selectively extendable and retractable ram is coupled between the support frame and the platform to selectively raise and lower the platform.

In another embodiment, a hydraulic or gear driven, selectively extendable and retractable ram is horizontally mounted to the frame and positioned under the bed. A ram extension lever is then coupled between the ram and the support platform such that extension or retraction of the ram correspondingly raises and lowers the leg lifting platform.

In another embodiment, the platform is raised and lowered by a selectively extendable and retractable ram that is coupled to a track guided push lever and ram extension lever. In addition, the platform is coupled to the frame with a sliding tube to raise the height of the platform as the platform is raised. This allows the platform to be positioned below the height of the mattress when the platform is in its lowered position and to raise to be level with the mattress as more of the weight of the user is carried by the platform causing a corresponding rise in the height of the mattress.

In another embodiment, the platform is raised and lowered by a rack and pinion gear arrangement that is linked by an extension lever to the platform to selectively raise and lower the platform. In addition, retractable support legs may be coupled to the rack and pinion assembly to cause support legs to extend beneath the platform as the platform rises.

In still another embodiment, the platform is raised while maintaining a generally horizontal orientation throughout. The platform is raised by a scissor-type frame assembly that raises the entire platform from a lower position to an elevated position.

In yet another embodiment, the platform is raised in a generally horizontal orientation by a cable-type, chain-type or ram-type system. The platform is maintained in a cantilevered arrangement throughout the lift.

Other embodiments employ chain and sprocket arrangements or cable assemblies for raising and lowering the platform as well as forward and/or rear support legs to allow the leg lifting apparatus to be self-supporting without attachment to the frame of the bed, floor or wall.

An adjustable and/or removable hand rail attached to the frame of the leg lifting apparatus may be provided with any of the foregoing embodiments. The hand rail provides the user with a structure upon which a force can be applied to assist the user in maneuvering their legs from the platform to the bed.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

Figure 1:
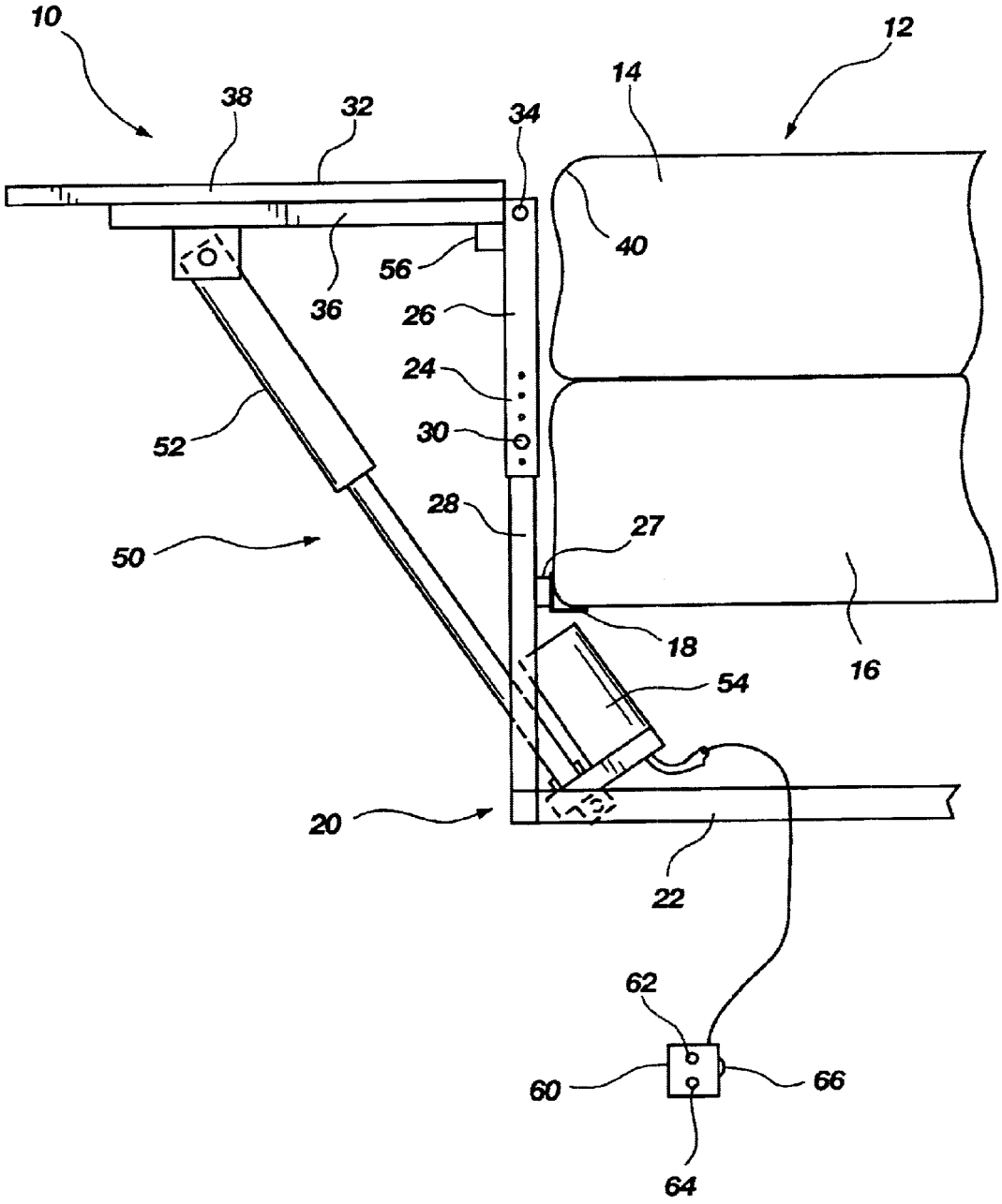
FIG. 1 is a side view of a first embodiment of a bedside lower extremity lifting apparatus in a raised position in accordance with the principles of the present invention.

FIG. 1 illustrates a first embodiment of a leg lifting apparatus, generally indicated at 10, in accordance with the principles of the present invention. The leg lifting apparatus 10 is positioned adjacent a conventional bed, generally indicated at 12, which includes a pair of mattresses 14 and 16 supported by a conventional bed frame 18. The leg lifting apparatus 10 is comprised of a support frame, generally indicated at 20, and includes a base portion 22 and an upright portion 24. The upright portion 24 maybe mounted to the bed frame 18 with a mounting bracket 27. Likewise, the base portion 22 may be secured to the floor or a wall with fastening means known in the art. The base portion 22 is positioned horizontally relative to the floor with the upright portion 24 oriented at approximately ninety degrees to the base portion 22. The base and upright portions 22 and 24 may be welded, bolted or otherwise attached to one another by methods known in the art. The height of the upright portion 24 may be adjusted by utilizing a pair of upright support members 26 and 28 that are telescopically coupled and or otherwise adjustably securable relative to each other as is known in the art, as by securing with one or more releasable pins 30.

A platform 32 is hingedly attached to the upright portion 24 as with a hinge assembly 34. The platform 32 comprises one or more platform support members 36 to which a sheet 38 is attached. Likewise, the sheet 38 may be formed from a material that is rigid enough to be self supporting without the support members 36. The platform 32 has a relatively thin profile so that when it is in a substantially vertical position, a user can easily sit on the edge 40 of the mattress 14 with the platform 32 comfortably positioned between the bed 12 and the legs (or leg for amputees) of a user.

The platform 32 is coupled to the base portion 22 with an actuator assembly, generally indicated at 50, for selective raising and lowering of the platform 32 relative to the upright portion 24. The actuator assembly comprises a telescopic ram system 52 driven by a motor/gearbox assembly 54. Likewise, the actuator 50 could include a hydraulic ram assembly with a hydraulic pump assembly 54. The actuator assembly 50 is pivotally coupled to and between the platform 36 and the base portion 22 as with bolt and bearing assemblies. Limit switches 56 electronically coupled to the actuator assembly 50 may be provided to prevent over extension or over retraction of the ram 52. That is, the limit switch 56 can ensure that the platform moves to horizontal, but not beyond horizontal, and back to its lowered vertical position. The motor 54 is electronically controlled by a hand held control unit 60 which includes one or more buttons 62 and 64 for controlling the movement of the platform 32. The control unit 60 may also include a safety button 66 which must be simultaneously depressed in combination with one of the other buttons 62 or 64 to activate the motor 54. Furthermore, safety button 66 may comprise a keyed switch that must be switched on with a key to keep unwanted persons from operating the device.

Figure 2:
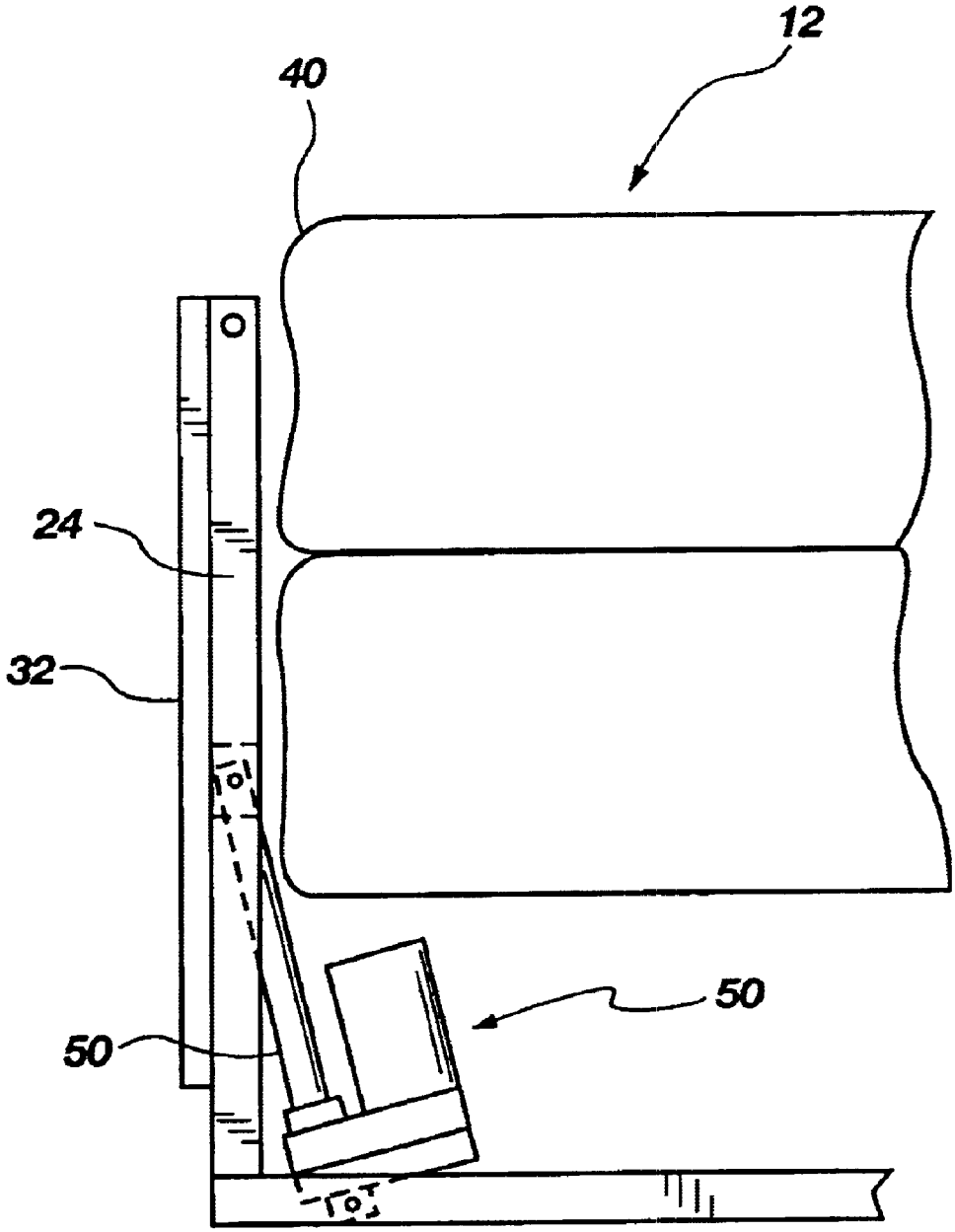
FIG. 2 is a side view of the bedside lower extremity lifting apparatus of FIG. 1 in a lowered position.

As shown in FIG. 2, the platform 32 is in its lowered, substantially vertical position. In this position, the user can sit on the edge 40 of the bed with their feet positioned on the floor. Activation of the actuator assembly 50 will cause the ram 50 to extend and lift the platform 32 as it pivots relative to the upright frame portion 24. The combination of the platform 32 and upright frame portion 24 present a relatively thin profile so as to allow a user to have the frame portion 24 and platform 32 positioned between the legs of the user and the bed 12. Once the platform 32 is raised to a substantially horizontal position as shown in FIG. 1, the user can maneuver their legs from the platform to the bed 12. It may also be the case that the user is capable of maneuvering their legs once the platform reaches a sufficiently horizontal position that will allow the particular user to comfortably move their legs from the platform 32 to the bed 12. In such a manner, problems otherwise associated with lifting ones legs into a bed are substantially alleviated. That is, the user does not have to use the muscles or joints associated with lifting ones legs into a bed in order to get back into bed. Of course, while certain reference has been made to association with a conventional bed, those of skill of art will appreciate that the present invention may be adapted for use with patient tables, hospital beds or any other elevated surface upon which a person desires to be positioned.

Figure 3:
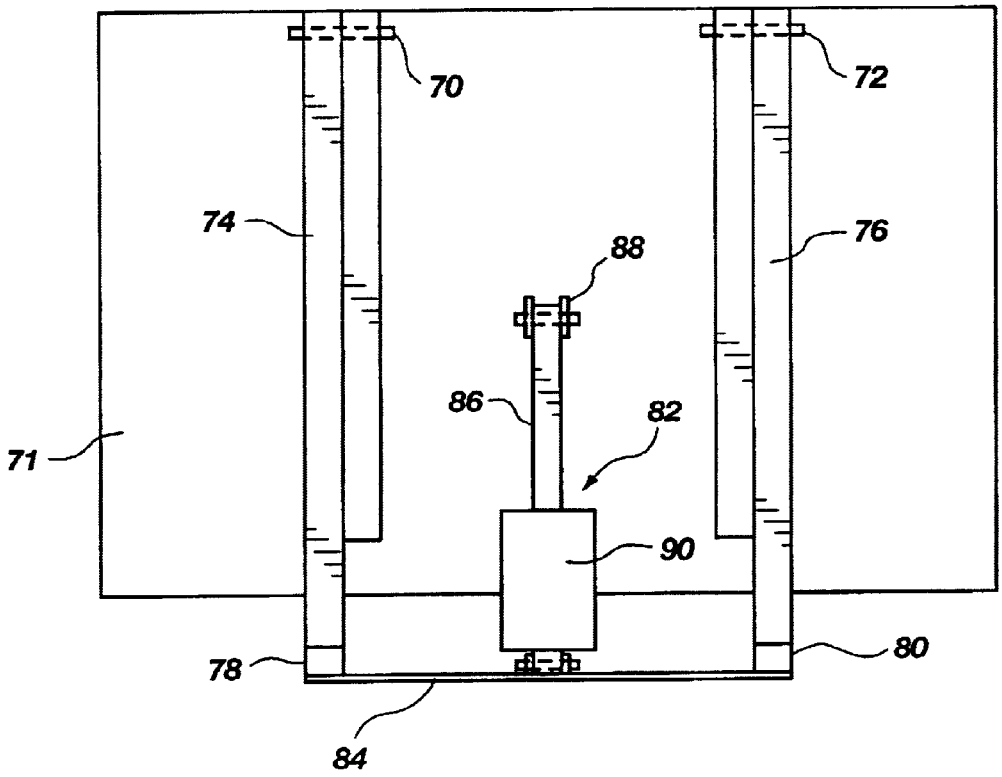
FIG. 3 is a back view of the bedside lower extremity lifting apparatus of FIG. 1 in a lowered position.

As shown in FIG. 3, the platform 71 is hingedly coupled, as with hinge pins 70 and 72 to a pair of upright frame members 74 and 76. The frame members 74 and 76 are attached to a pair of base frame members 78 and 80, respectively. The actuator assembly 82 is mounted with a bracket to a transversely extending member 84 with the ram 86 pivotally mounted to the platform 71 as with a pin/bracket assembly 88. The ram 86 is mounted proximate the center of the back side of the platform 71 so as to provide sufficient lifting force against the platform while minimizing the distance beneath the bed where the actuator motor 90 resides. It is also possible to utilize two such rams 86 in a spaced apart manner attached to the platform 71.

Figure 4:
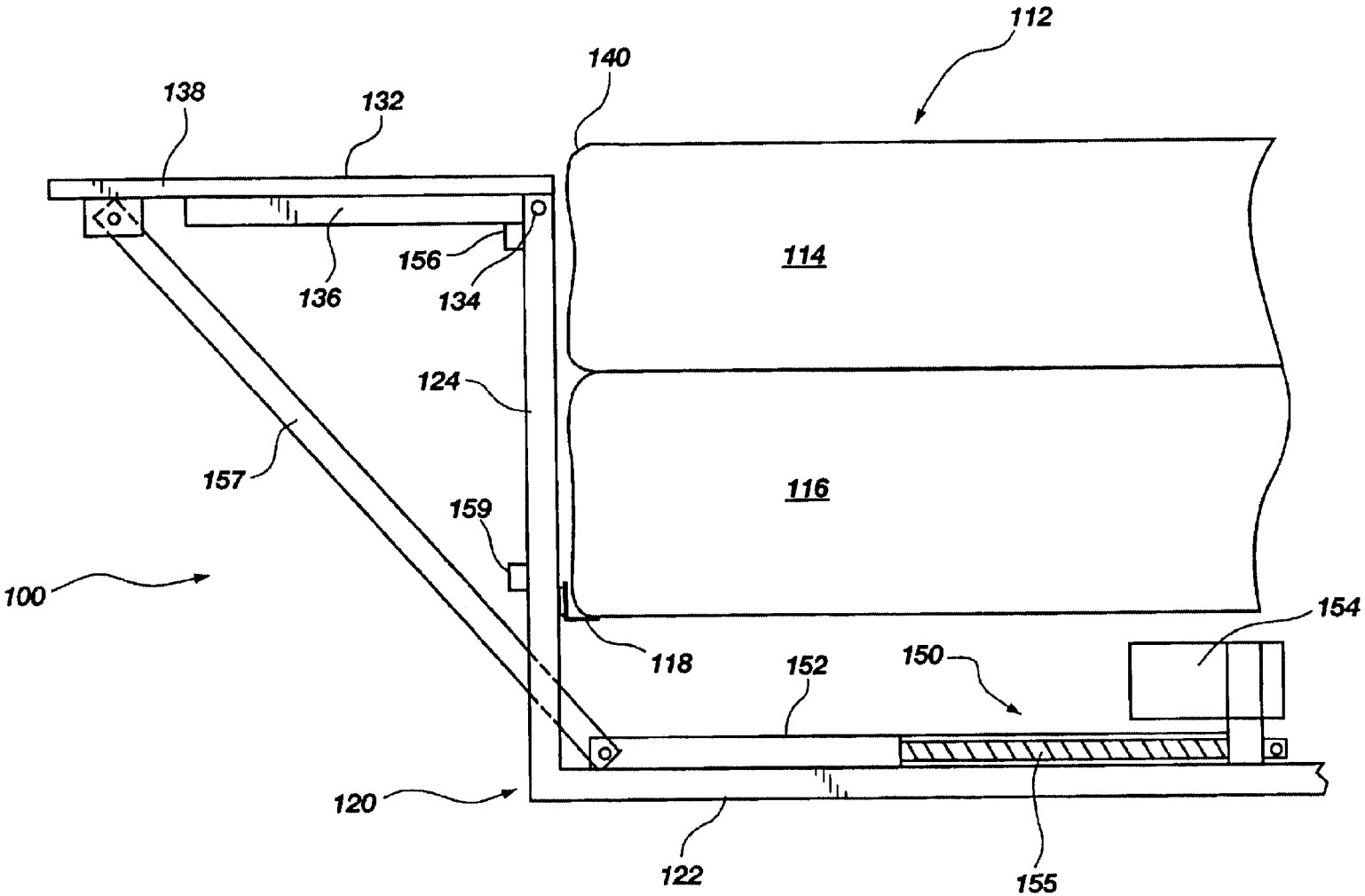
FIG. 4 is a side view of a second embodiment of a bedside lower extremity lifting apparatus in a raised position in accordance with the principles of the present invention.

FIG. 4 illustrates another embodiment of a lower extremity lifting apparatus, generally indicated at 100, in accordance with the principles of the present invention. The leg lifting apparatus 100 is positioned adjacent a conventional bed, generally indicated at 112, which includes a pair of mattresses 114 and 116 supported by a conventional bed frame 118. The leg lifting apparatus 100 is comprised of a support frame, generally indicated at 120, and includes a base portion 122 and an upright portion 124. The upright portion 124 is attached to the bed frame 118 to provide stability to the upright portion 124 relative to the bed 112. The base portion 122 is positioned horizontally relative to the floor with the upright portion 124 oriented at approximately ninety degrees to the base portion 122. The base and upright portions 122 and 124 may be welded, bolted or formed from a common element that is bent into an L-shaped member.

A platform 132 is hingedly attached to the upright portion 124 as with a hinge assembly 134. The platform 132 comprises one or more platform support members 136 to which a sheet 138 is attached. The platform 132 has a relatively thin profile so that when it is in a substantially vertical position, a user can easily sit on the edge 140 of the mattress 114 with the platform 132 comfortably positioned between the bed 112 and the legs of a user.

The platform 132 is coupled to the base portion 122 with an actuator assembly, generally indicated at 150, for selective raising and lowering of the platform 132 relative to the upright portion 124. The actuator assembly comprises a telescopic ram system 152 driven by a motor/gearbox assembly 154. The ram system includes a threaded shaft 155, rotation of which causes extension and/or retraction of the ram system 152 depending upon the direction of rotation. Likewise, the actuator 150 could comprise a hydraulic or pneumatic ram assembly. A ram extension lever 157 is pivotally coupled to and between the platform 36 and the ram system 152 as with bolt and bearing or pin type assemblies. Limit switches 156 and 159 electronically coupled to the actuator assembly 150 may be provided to prevent over extension or over retraction of the ram 152. That is, the limit switch 156 can ensure that the platform moves to horizontal, but not beyond horizontal. The motor 154 is electronically controlled by a hand held control unit which includes one or more buttons for controlling the movement of the platform 132. The control unit may also include a safety button which must be simultaneously depressed in combination with one of the other buttons to activate the motor 154 or a keyed switch.

Figure 5A:
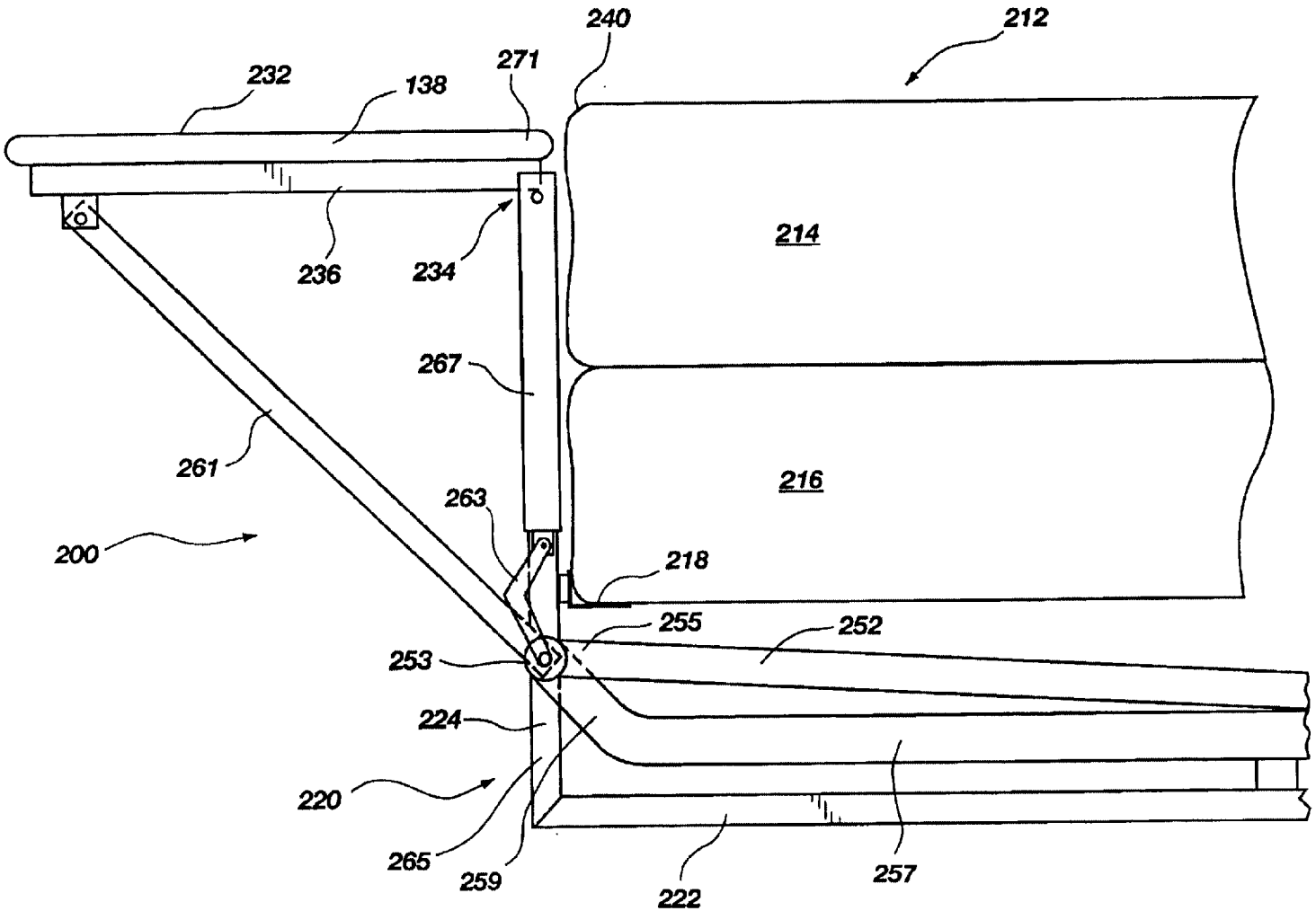
FIGS. 5A and 5B are partial side views of a third embodiment of a bedside lower extremity lifting apparatus in a raised position in accordance with the principles of the present invention.
Figure 5B:
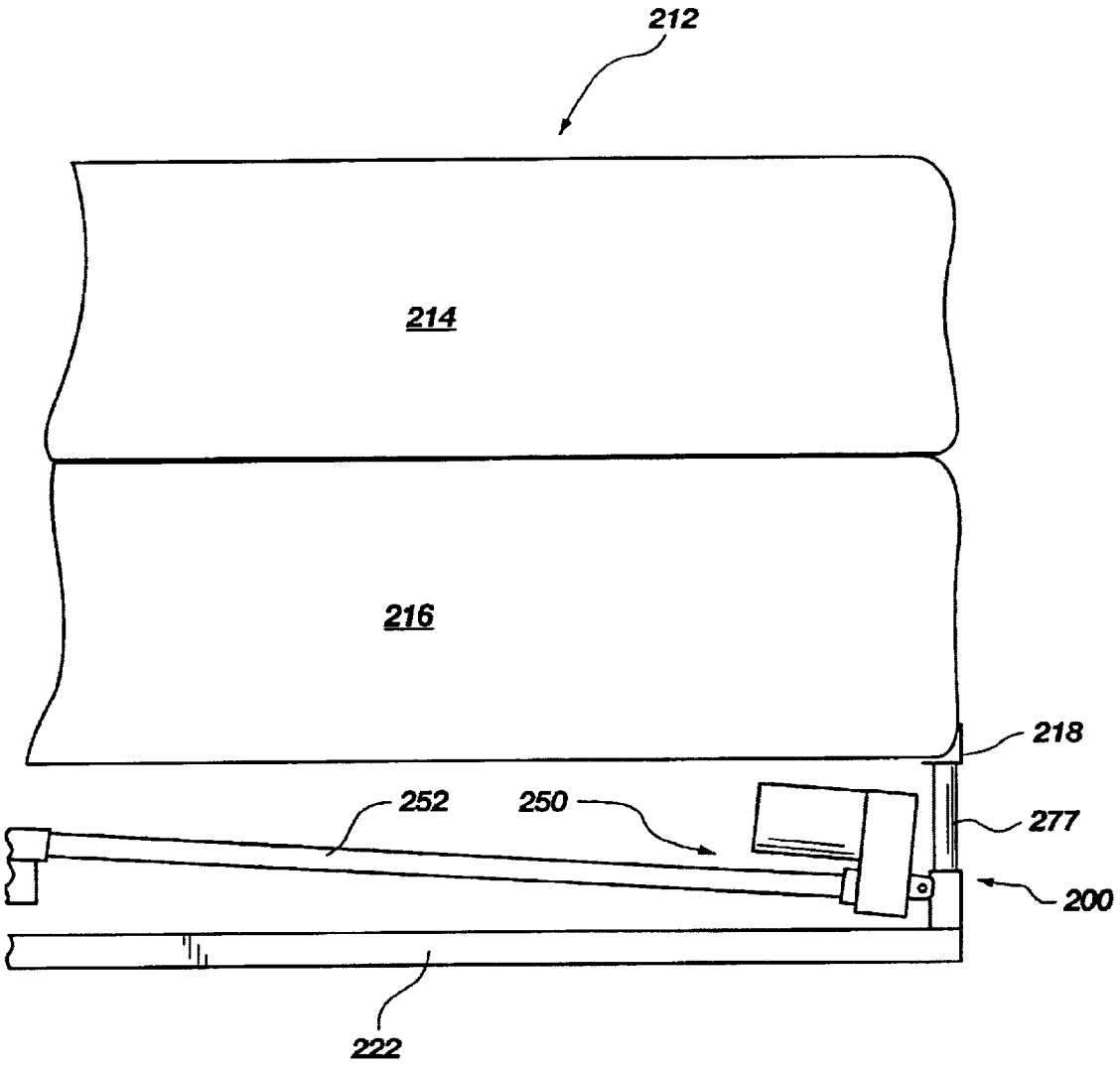

FIGS. 5A and 5B illustrate yet another embodiment of a leg lifting apparatus, generally indicated at 200, in accordance with the principles of the present invention. The leg lifting apparatus 200 is positioned adjacent to a conventional bed, generally indicated at 212, which includes a pair of mattresses 214 and 216 supported by a conventional bed frame 218. The leg lifting apparatus 200 is comprised of a support frame, generally indicated at 220, and includes a base portion 222 and an upright portion 224. The upright portion 224 is attached to the bed frame 218 to provide stability to the upright portion 224 relative to the bed 212. The base portion 222 is positioned horizontally relative to the floor with the upright portion 224 oriented at approximately ninety degrees to the base portion 222. The base and upright portions 222 and 224 may be welded, bolted or formed from a single integrated member that is bent into an L-shaped member.

A platform 232 is hingedly attached to the upright portion 224 as with a hinge assembly 234. The platform 232 comprises one or more platform support members 236 to which a padded sheet-like member 238 is attached. The padding may comprise foam type pads with a cover extending there over. The surface of the member 238 should be relatively smooth as with a vinyl type cover to allow easy sliding of one's legs from the platform 232 to the bed 212. As with the other embodiments described herein, the platform 232 has a relatively thin profile so that when it is in a substantially vertical position, a user can easily sit on the edge 240 of the mattress 214 with the platform 232 comfortably positioned between the bed 212 and the legs of a user.

The platform 232 can be selectively elevated by activation of an actuator assembly, generally indicated at 250. The actuator assembly is capable of selectively raising and lowering the platform 232 relative to the upright portion 224. In this embodiment, the actuator assembly 250 comprises a telescopic ram 252 coupled to a wheel assembly 253 at a distal end 255 thereof. A guide track 257 is provided to receive the wheel assembly 253 and guide the wheel assembly along the path of the track 257. A portion of the track 257 extends substantially horizonally with an inclined portion 259 extending at the distal end of the track 257.

The distal end of the ram 257 is pivotally coupled to a ram extension member 261 that is coupled between the ram 257 and the platform 232. As the wheel assembly 253 guides the distal end of the ram 252 along the inclined portion 259, the ram 252 and wheel are elevated to engage with a secondary platform lifting member 263. The upright frame portion 224 is comprised of a pair of telescopic members 265 and 267. The secondary lifting member 263 is pivotally coupled to the bottom of the telescopic member 267. The secondary lifting member 263 is configured to engage with the ram member or wheel assembly as the wheel assembly glides along the inclined portion 259. Once engaged, as the wheel assembly rises along the inclined portion 259, the secondary lifting member causes the telescopic member 267 to rise. This causes the proximal end or edge 271 of the platform 232 to elevate accordingly. As such, the edge 271 of the platform 232 can start at a lower height when the platform is in its lowered, substantially vertical or "pre-loading" position to allow a user to sit on the edge 240 of the mattress and compress the mattress without interference from the top edge 271 of the platform 232. As the platform rises from the ram extension member 261, the edge 271 rises accordingly as the legs of the user are lifted and the compression of the mattress 214 along its edge 240 lessens.

As further illustrated in FIG. 5B, the ram assembly 250 is pivotally coupled to the base member 222 to allow the ram assembly 250 to pivot as the wheel assembly 253 follows the track 257. In addition, further support is provided by attaching the base member 222 to the frame 218 with an additional vertical frame member 277.

Figure 6A:
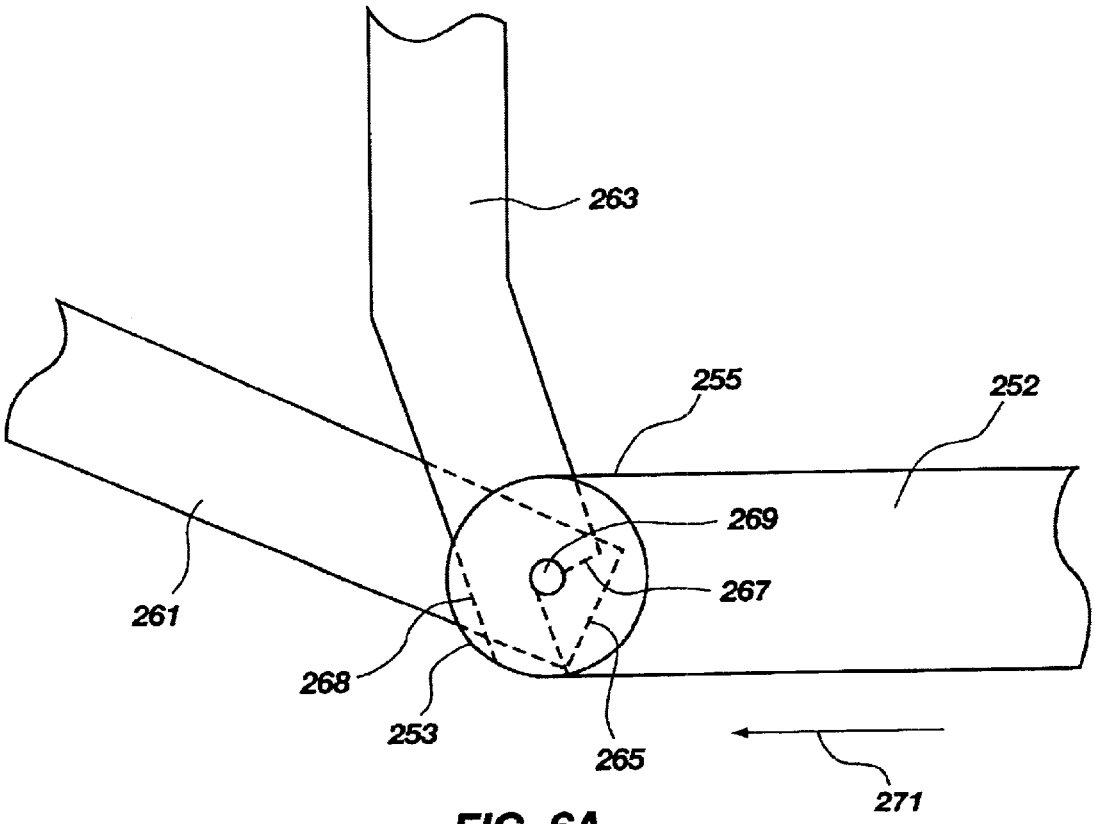
FIGS. 6A and 6B are side and top view of a secondary platform lifting device in accordance with the principles of the present invention.

FIG. 6A is a close-up view of the wheel/lever assembly shown in FIG. 5A. The wheel 253 is rotatably coupled to the distal end 255 of the primary ram lever 252 as well as the proximal end 265 of the ram extension lever 261 in a manner that allows the ram lever 252 and the ram extension lever 261 to pivot relative to one another. The distal end 268 of the secondary lifting member 263 is provided with a notch 267 for receiving and engaging the shaft or axle 269 of the wheel 253. Thus, as the primary ram lever 253 moves in the direction of the arrow 271, the axle 269 engages the notch 267 of the secondary lifting member 263 to raise the lifting member 263 as the wheel moves along the track 257 (see FIG. 5A).

Figure 6B:
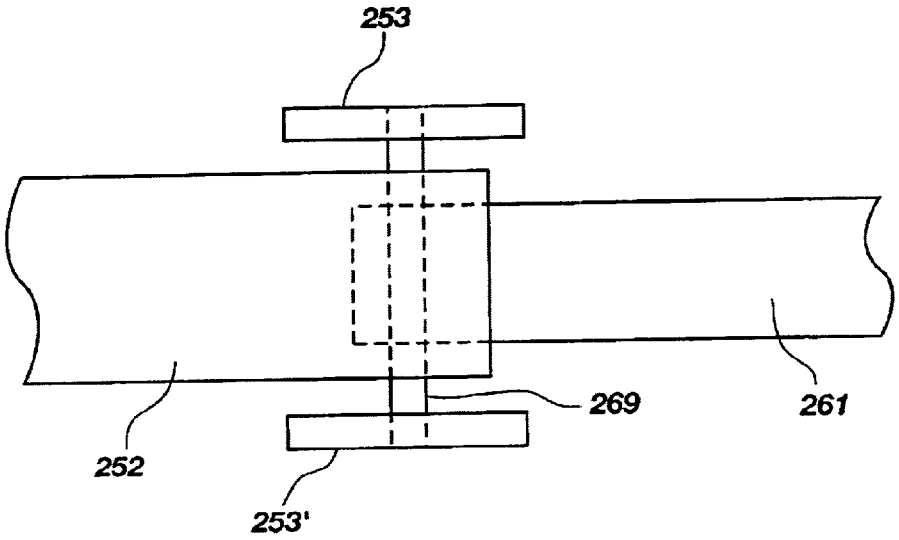

As further shown in FIG. 6B, the wheel/lever assembly is comprised of a pair of wheels 253 and 253' separated by the axle 269 which pivotally couples the levers 252 and 261 together. While the wheel/lever/track assembly has been illustrated with reference to a particular embodiment, those of skill in the art after understanding the principles of the present invention will appreciate that other track guided arrangements may be employed. For example, the wheels 253 and 253' prime may be replaced by a single wheel or a guide member that can simply slide through the track with the same effect as the wheel/track arrangement of the present invention.

Figure 7:
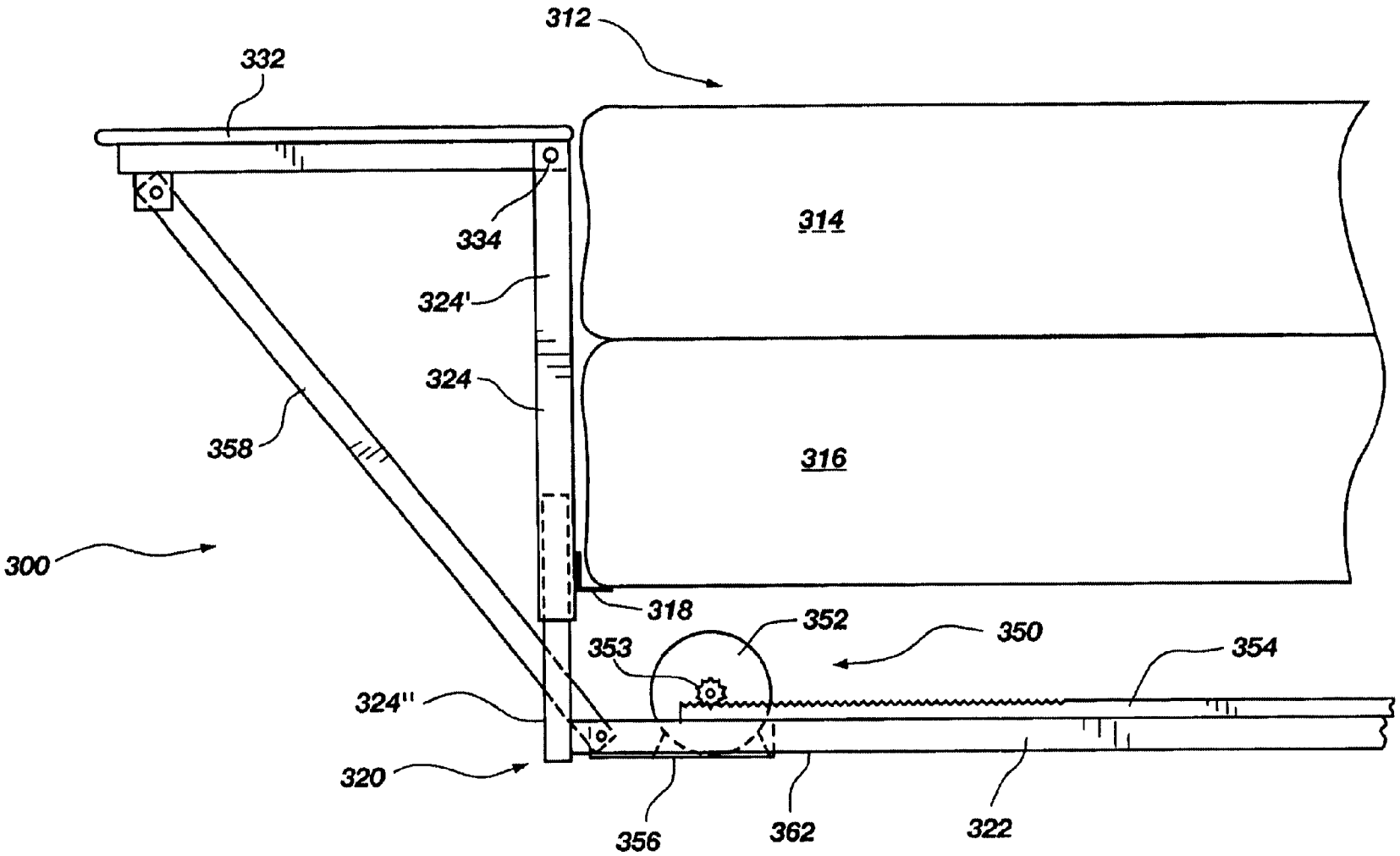
FIG. 7 is a side view of a fourth embodiment of a bedside lower extremity lifting apparatus in a raised position in accordance with the principles of the present invention.

FIG. 7 illustrates another embodiment of a lower extremity lifting apparatus, generally indicated at 300, in accordance with the principles of the present invention. As in other embodiments illustrated herein, the leg lifting apparatus 300 is positioned adjacent a conventional bed, generally indicated at 312, which includes a pair of mattresses 314 and 316 supported by a conventional bed frame 318. The leg lifting apparatus 300 is comprised of a support frame, generally indicated at 320, and includes a base portion 322 and an upright portion 324. The upright portion 324 is attached to the bed frame 318 to provide stability to the upright portion 324 relative to the bed 312. The base portion 322 is positioned horizontally relative to the floor with the upright portion 324 oriented at approximately ninety degrees to the base portion 322. The upright portion 324 may be formed from a pair of telescopic members 324' and 324" so as to allow the height of the upright frame portion 324 to be adjustable. The frame portions 322 and 324 may bolted together to allow the frame 320 to be disassembled.

A platform 332 is hingedly attached to the upright portion 324 with a hinge assembly 334. The platform 332 is coupled to the base portion 322 with an actuator assembly, generally indicated at 350, for selective raising and lowering of the platform 332 relative to the upright portion 324. The actuator assembly comprises a gear head motor 352 in which the gear 353 engages a gear rack 354 to form a rack and pinion arrangement. The rack 354 is mounted to a base member 362. The motor 352 is mounted to a movable carriage 356 to which the platform elevating lever 358 is coupled. As the motor 352 moves along the rack 354, the lever 358 correspondingly raises or lowers the platform 332.

Figure 8:
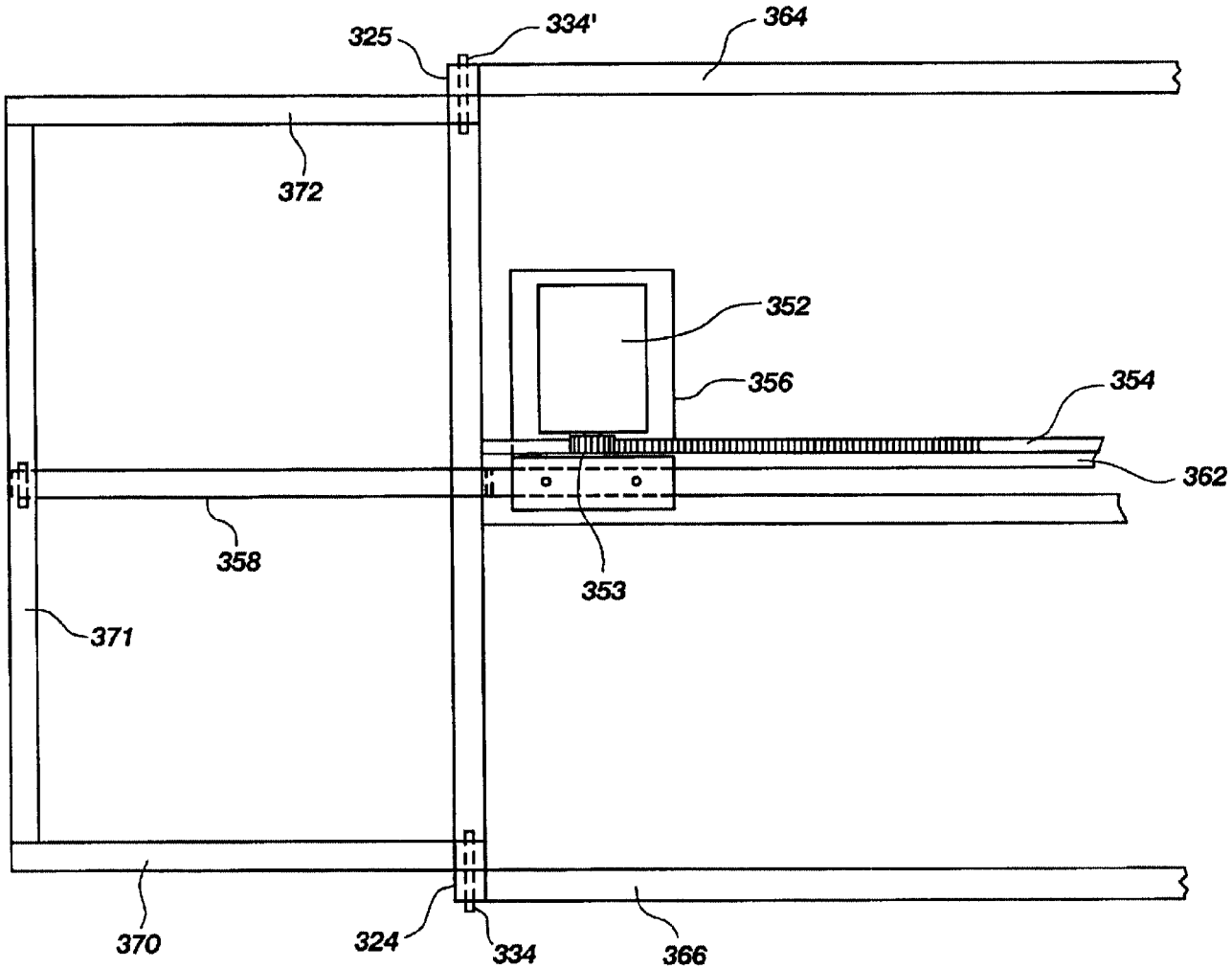
FIG. 8 is a top view of the bedside lower extremity lifting apparatus of FIG. 7.

As further illustrated in FIG. 8, the rack 354 and pinion gear 353 are positioned proximate the center of the platform 332 with supporting base members 364 and 366 supporting the upright members 324 and 325. Likewise, a double gear/rack assembly may be employed. As the carriage 356 and motor 352 move relative to the rack 354, the lever 358 raises or lowers the platform frame members 370, 771 and 372 relative to the hinge assemblies 334 and 334' comprised of hinge pins. Thus, the carriage 356 pushes or pulls the lever 358 as the motor 352 drives the gear 353 along the rack 354. The rack 354 and gear 353 may be covered with a housing or bellows assembly (not shown) in order to prevent objects from becoming caught between the gear 353 and the rack 354 during operation.

Figure 9:
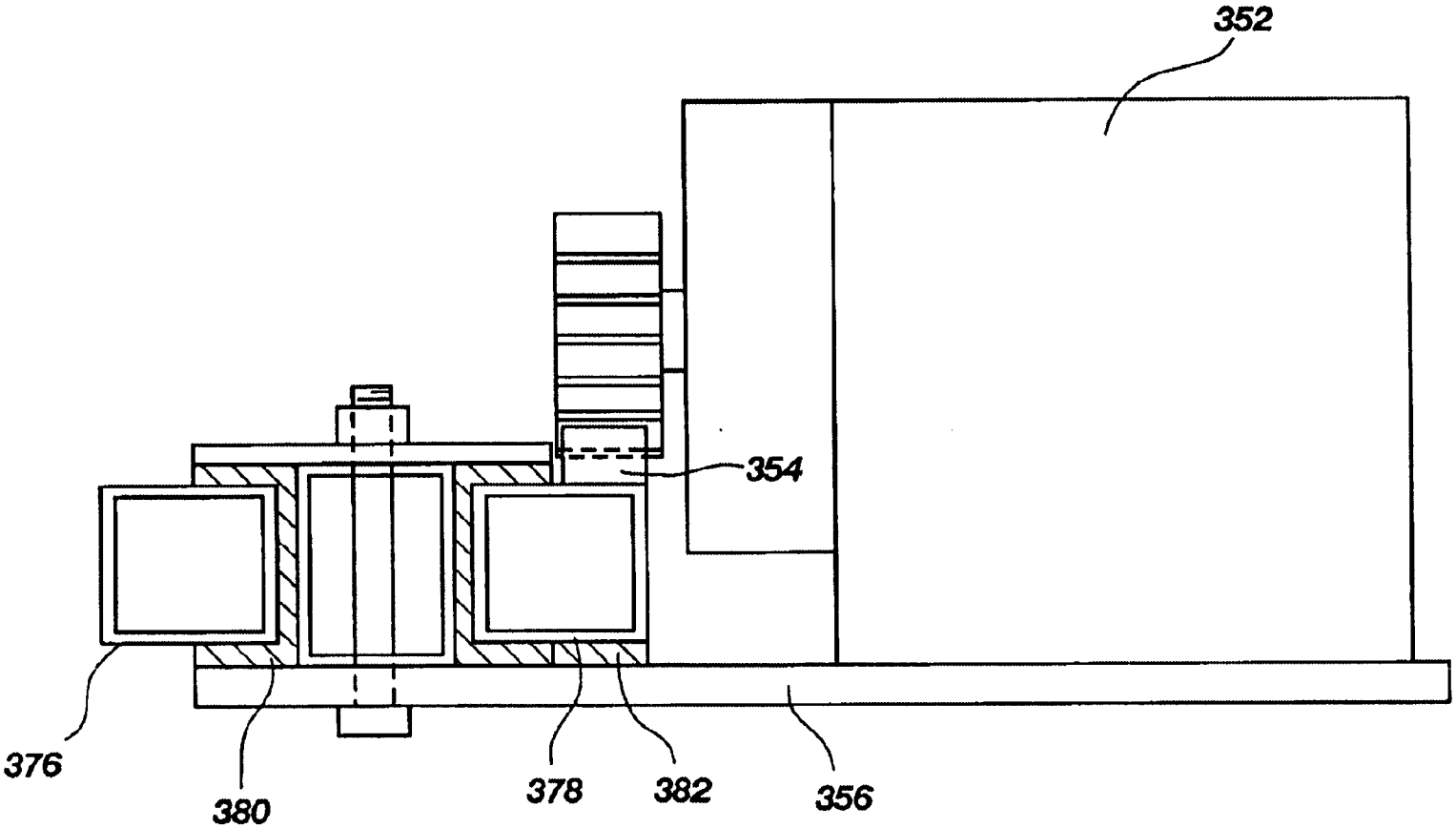
FIG. 9 is an end view of the rack and pinion assembly shown in FIG. 7.

As shown in FIG. 9, the carriage 356, to which the motor 352 is mounted, is coupled to a pair of elongate members 376 and 378 with the rack 354 mounted to the member 378. TEFLON or other types of bearings 380 and 382, such as UHMW, are formed around the members 376 and 378, respectively, to allow the members 376 and 378 and thus the carriage 356 to slide along the bearings 380 and 382. By translating the motor relative to a stationary rack, the overall length of the rack assembly is reduced. It is noted however, that if space is not a concern, the motor could be stationarily mounted and the rack moved relative thereto to raise and lower the platform.

Figure 10:
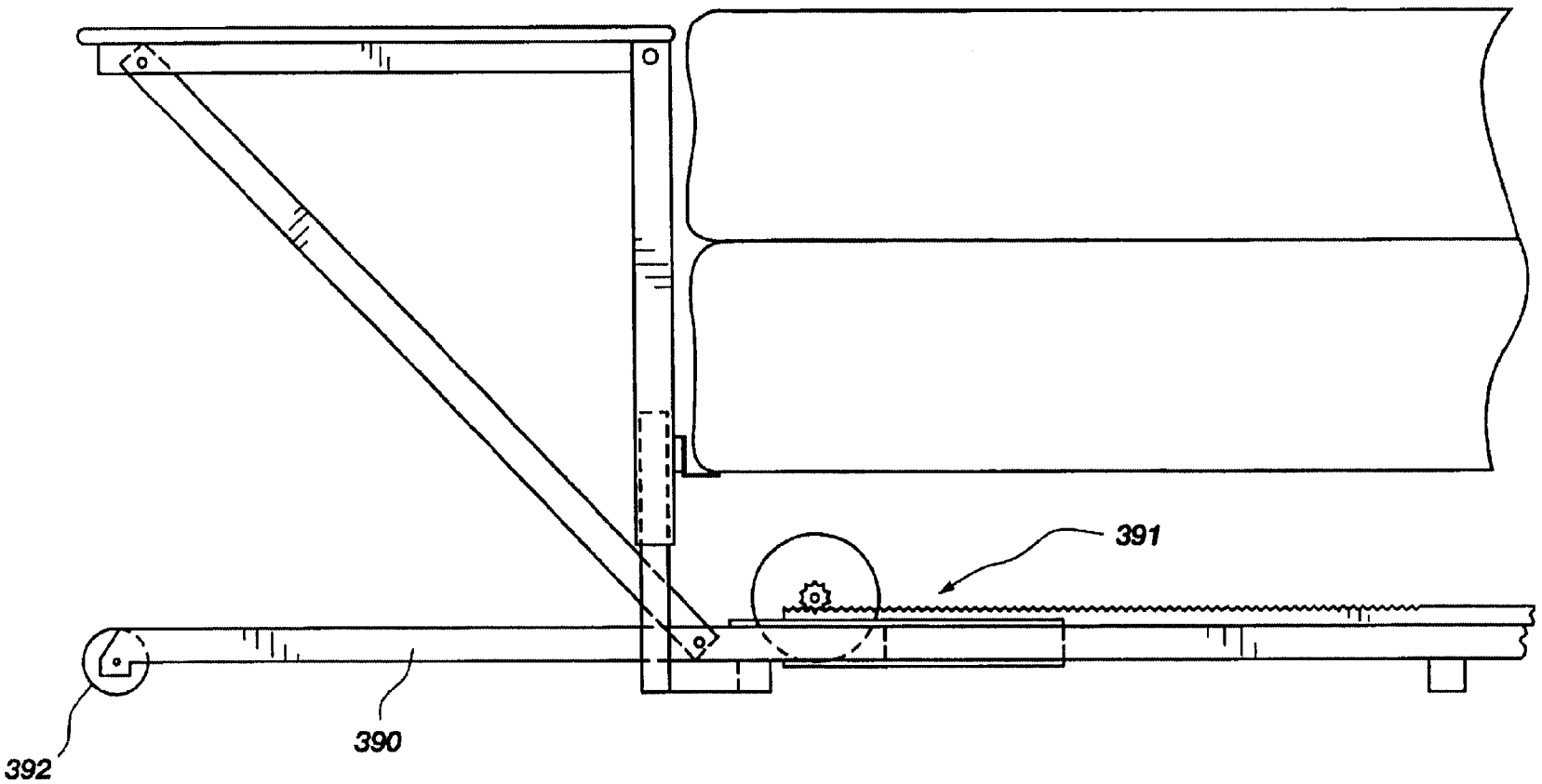
FIG. 10 is a side view of a fifth embodiment of a bedside lower extremity lifting apparatus in a raised position in accordance with the principles of the present invention.
Figure 11:
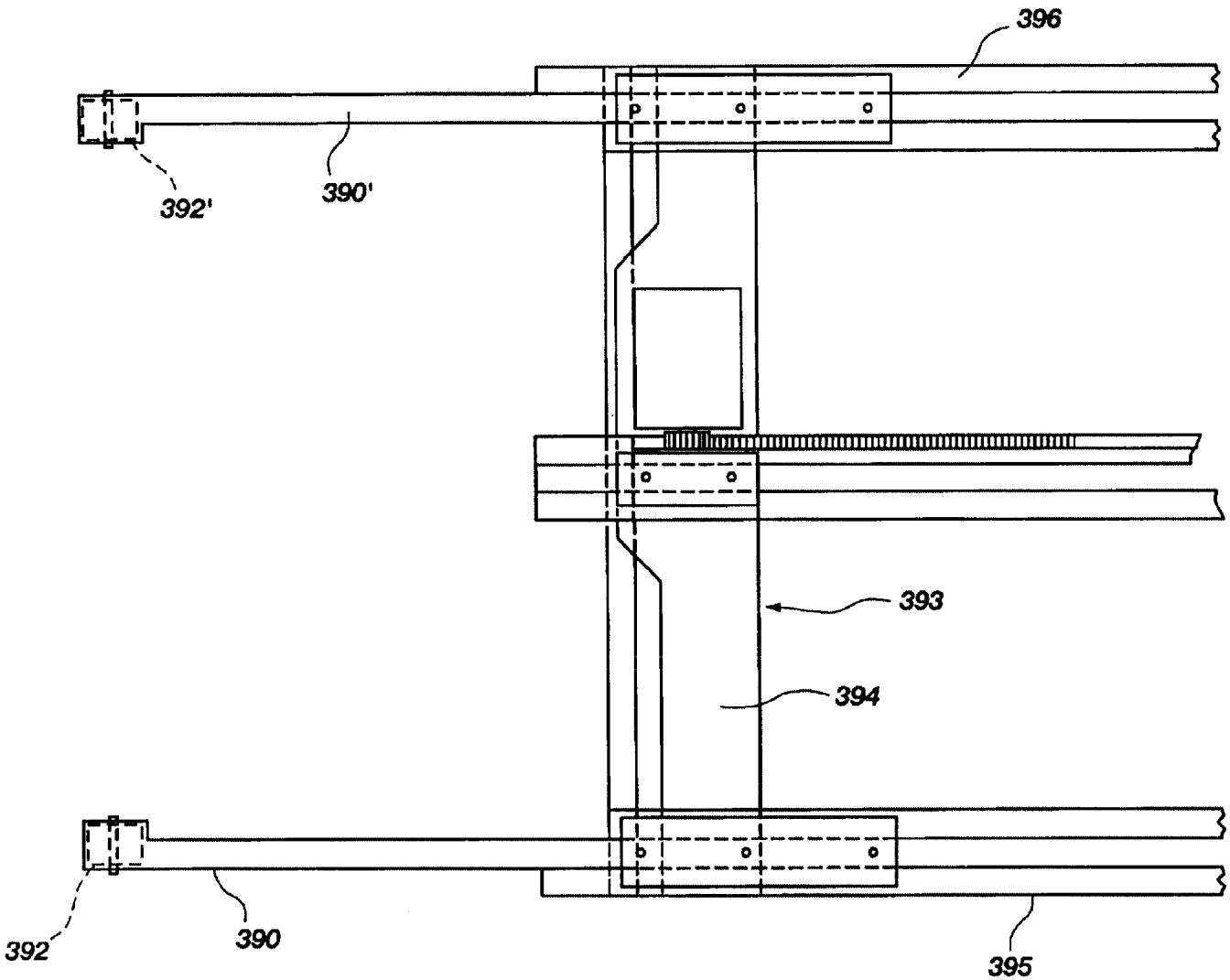
FIG. 11 is a top view of the bedside lower extremity lifting apparatus of FIG. 10.
Figure 12:
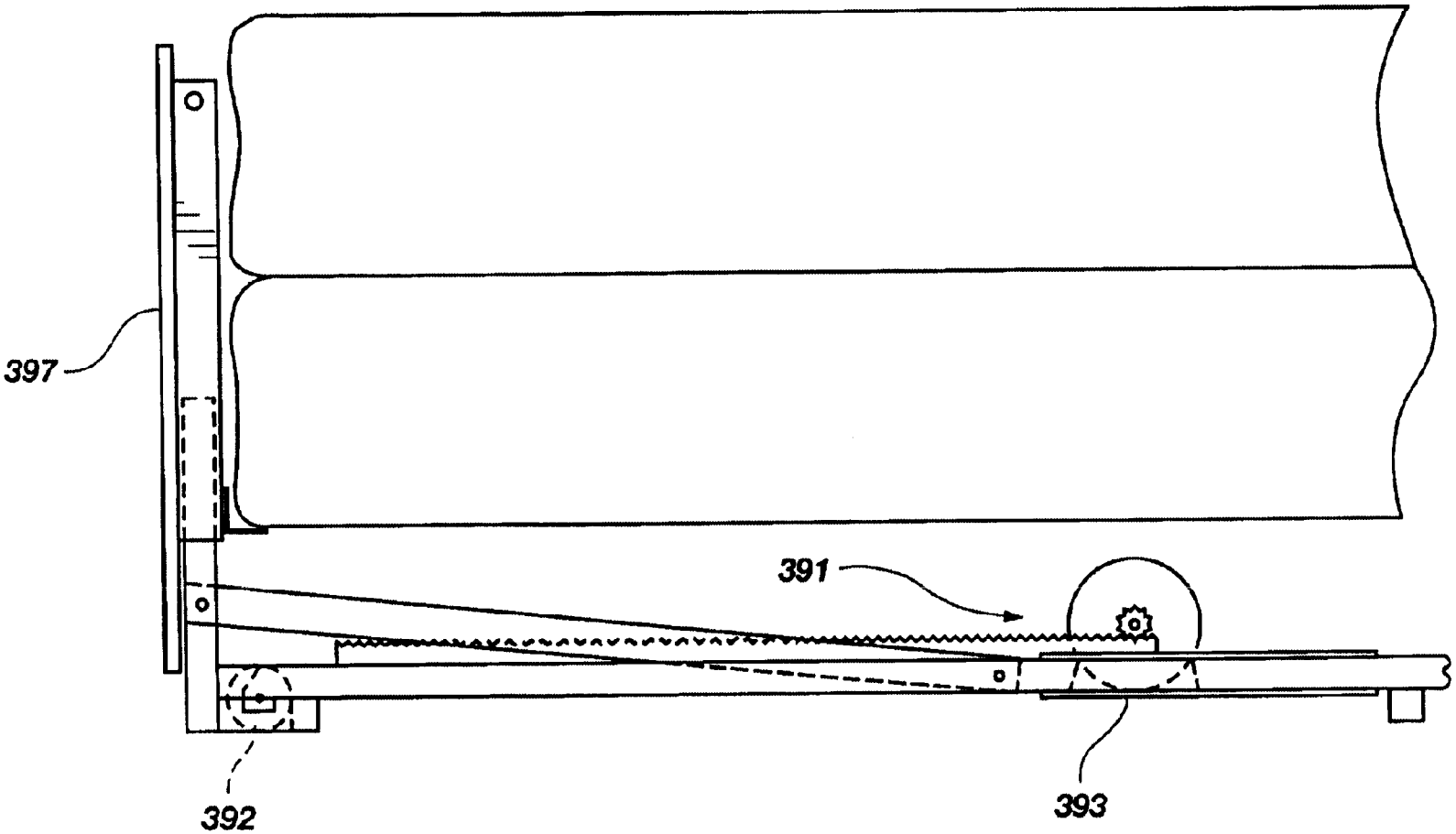
FIG. 12 is a side view of the bedside lower extremity lifting apparatus of FIG. 10 with the legs in a retracted position.

As shown in FIGS. 10, 11 and 12, retractable support legs 290 may be coupled to the rack assembly 391, such as the rack assembly shown in FIGS. 7, 8, and 9. In FIG. 10, the legs 390 are shown in a fully extended position with the platform in a substantially horizontal position. The support legs 390 are provided with idler wheels 392 at their distal end so as to provide smooth and easy extension and retraction of the legs 390.

As further illustrated in FIG. 11 the legs 390 and 390' are coupled to a carriage assembly 393. The carriage assembly 393 includes a an elongate plate member 394 slidably coupled to the lower frame members 395 and 396 in a manner similar to that shown in FIG. 9 as well as to the extension legs 390 and 390'. This allows the legs 390 and 390' to be driven by the same carriage 393 that extends and retracts the platform lever (not shown). Thus, the carriage 393 drives the platform lever as well as both support legs simultaneously. As such, the ends of the legs housing the wheels 392 and 392' move outwardly along with the extension or raising of the platform. In such a manner, the legs 390 and 390' do not provide an obstruction beyond the outer edge of the platform when the platform is retracted (as shown in FIG. 12). Furthermore, the legs 390 and 390' provide support for the platform 397 where and when support is needed. That is, the wheels 392 and 392' are configured to extend along with the extension of the platform 397 so as to always provide stability below the platform 397 so as to prevent the platform from ever tipping forward.

Figure 13:
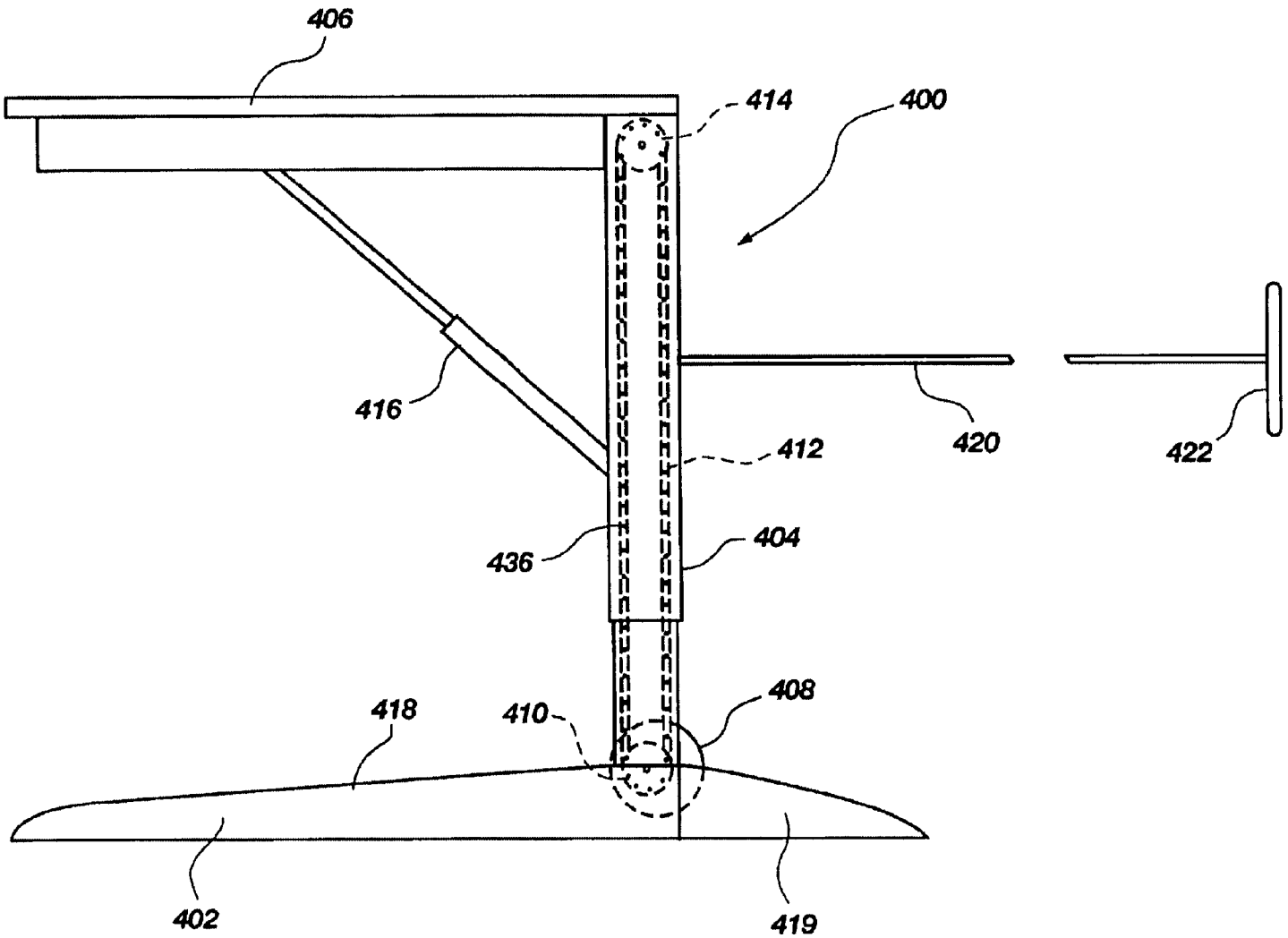
FIG. 13 is a side view of a sixth embodiment of a bedside lower extremity lifting apparatus in a raised position in accordance with the principles of the present invention.

Various other embodiments are also contemplated, such as the leg lifting apparatus, generally indicated at 400, of FIG. 13. The leg lifting apparatus 400, is a completely self-supporting, free standing device comprising a base 402 an upright support structure 404 and a pivotally mounted platform 406. The platform 406 is configured to be raised and lowered by a chain driven arrangement that does not require floor space to the rear of the device 400. A motor 408 drives a first sprocket 410 positioned proximate to the base 402. The sprocket 410 drives a chain 412 coupled to a second or upper sprocket 414 coupled to the platform 406. Thus, as the motor 408 rotates the lower sprocket 410, the chain 412 causes a corresponding rotation in the upper sprocket 414 and movement of the platform 406 about the sprocket 414. The chain may be comprised of a single, double or triple roller chain, a hivo chain or other belts or chains known in the art.

An additional charged lift 416 (such as a lift gate plunger) may be provided to prevent sudden dropping of the platform 406. In addition, the charged lift 146 provides resistance against the chain drive to provide smooth lifting and lowering of the platform 406 as the chain drive operates. As with other structures and devices described herein, the charged lift 416 may be employed with the other illustrative embodiments of the present invention.

The base 402 is provided with forward supporting legs 418 to eliminate need for support relative to the frame of a bed or other structure. The legs 418 may comprise left and right leg members or a continuous single sloped platform that can be walked and stood upon. In either case, it is preferable that such legs 418 present a relatively low profile so as to reduce the possibility of a user tripping over the legs 418. Likewise, the legs 418 may also be covered to form a small step. The rear portion 419 of the legs may be provided for additional stability or can be removed when the device is used in conjunction with a bed or other structure where such rearward support is not needed or not possible due to the limitation of space for such rearwardly extending portions 419.

As further illustrated in FIG. 13, a nylon, steel or plastic tether 420 is attached to the upright support 404. The tether or strap may be placed between the mattresses and tightened to firmly hold the T bracket 422 against the side of the mattresses opposite the leg lifting apparatus 400. It may be desirable to provide one or more such tethers to securely hold the apparatus 400 relative to a bed. For other types of structures, such as hospital beds and patient tables, other tethering arrangements may be provided and customized to the particular structure.

Figure 14:
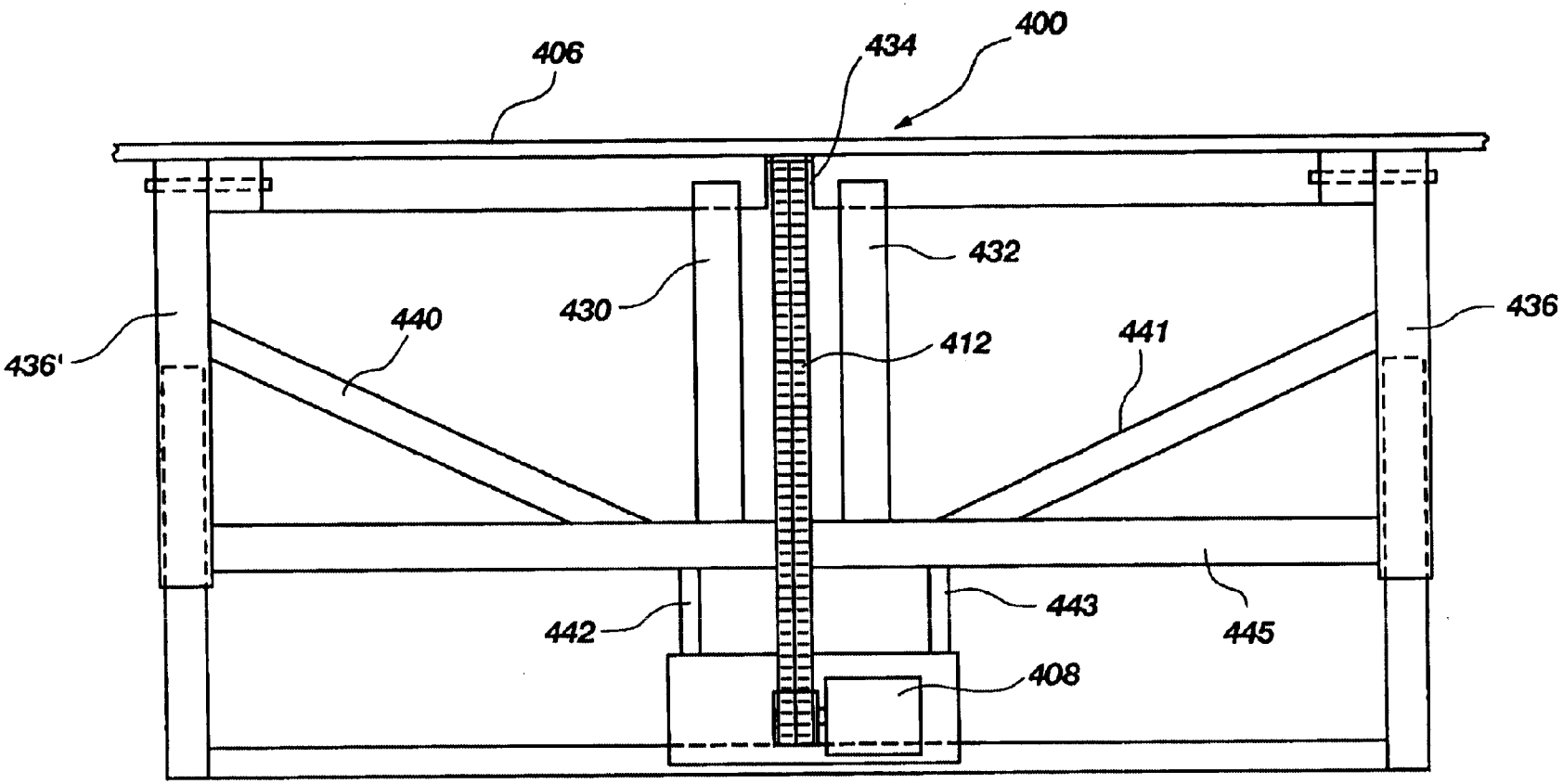
FIG. 14 is a back view of the bedside lower extremity lifting apparatus of FIG. 13 in a lowered position.

As shown in FIG. 14, the chains 412 are centrally located relative to the platform 406 of the leg lifting apparatus 400 so as to provide a central lifting location and even torque to both sides of the platform 406. The chains 412 may also be positioned to one side or separated on opposite sides of the platform 406. Legs 430 and 432 are provided to support both ends of the sprocket shaft 434 and are formed from a tube-like member, such as a round, square, C-shaped, or other configuration. The motor 408 is mounted to the upper telescopic frame member 436 so as to travel with adjustment. Extra bracing 440, 441, 442, 444 and 445 is provided to handle the high torque supplied by the motor to lift the platform 406.

Figure 15:
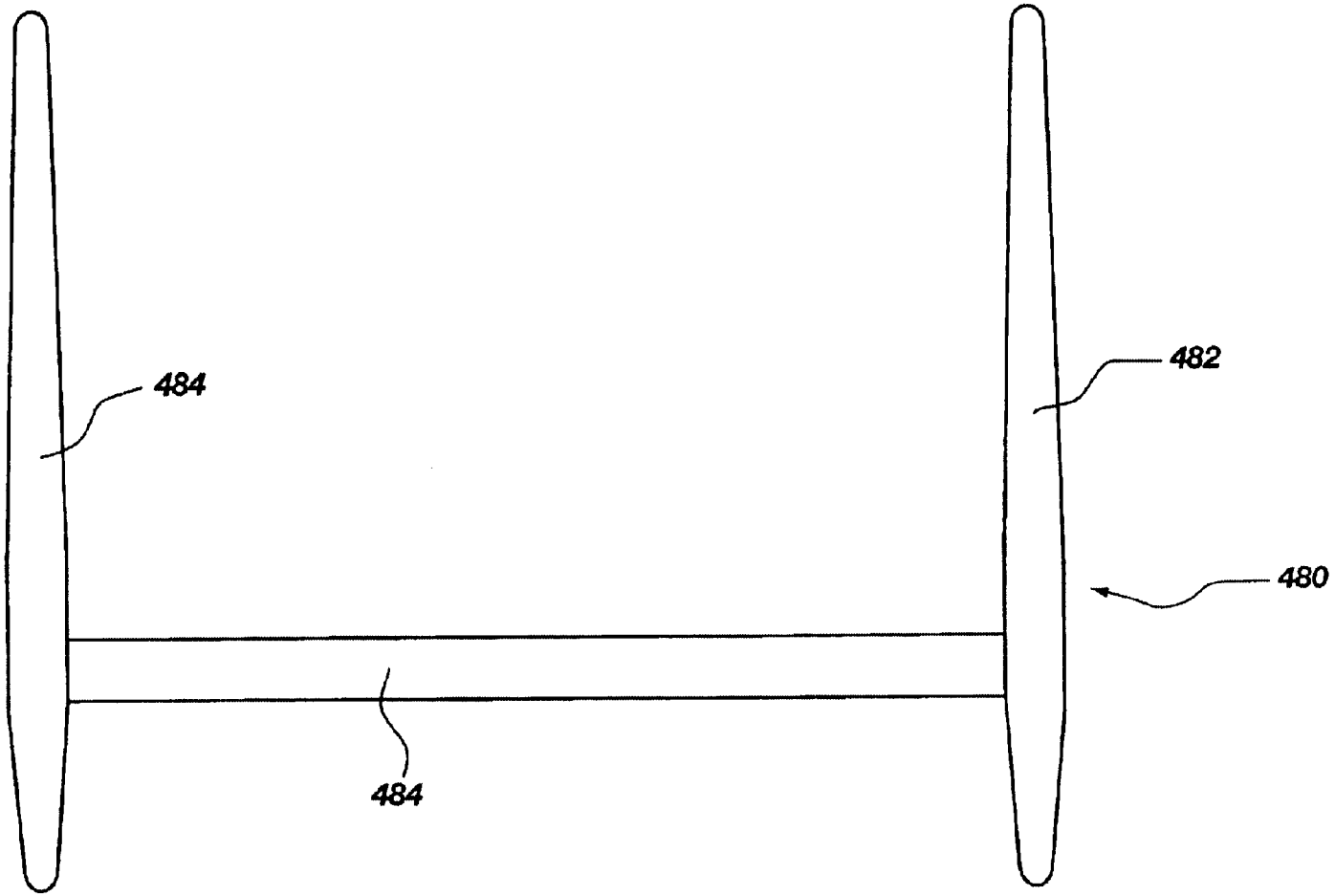
FIG. 15 is a top view of a base support structure for a bedside lower extremity lifting apparatus in accordance with the principles of the present invention.

FIG. 15 shows a base frame member, generally indicated at 480 that may be employed to provide a free-standing, self-supporting leg lifting apparatus according to the present invention. The base frame member 480 is comprised of a pair of legs 482 and 484 that extend for and aft of the cross-member 484. As previously discussed, the legs may be covered with a step to provide a raised platform. The legs 482 and 484 extend a sufficient distance in the forward direction so as to provide sufficient support under the platform as it is raised or lowered. The rear portions of the legs 482 and 484 are provided for stability, but because the majority of the force on the device is configured to be in front of the cross-member, the length of the rear portions can be significantly shorter.

Figure 16:
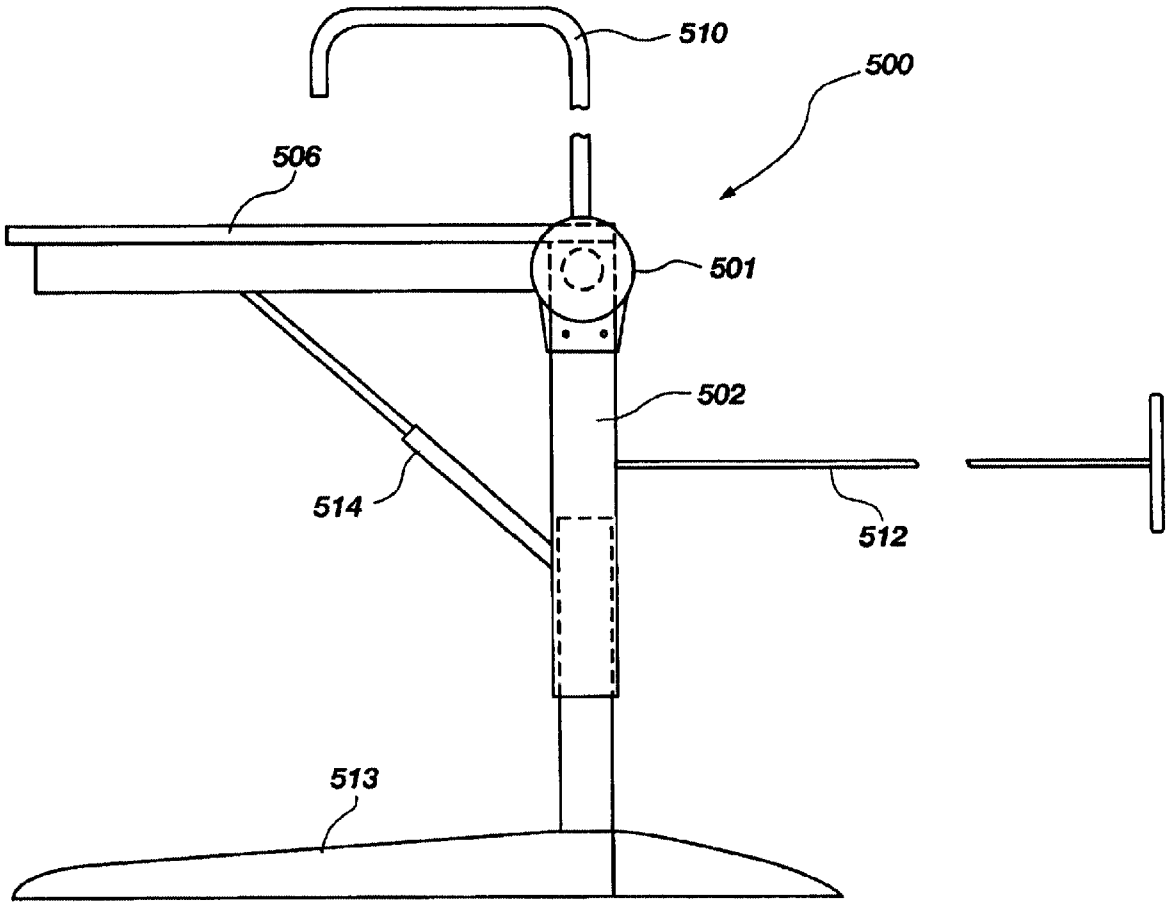
FIG. 16 is a side view of a seventh embodiment of a bedside lower extremity lifting apparatus in a raised position in accordance with the principles of the present invention.

In FIG. 16, the leg lifting apparatus 500 includes a high torque gear head motor 501 mounted to either end of the upright frame portion 502. The motor raises or lowers the platform 506 by direct engagement with the hinge assembly of the platform. That is, the motor may be directly coupled to a central shaft, rotation of which causes movement of the platform 506. Similarly, a simple gear arrangement may be coupled to the platform 506 to cause raising or lowering. As with other embodiments, herein, hand rails 510, support tethers 512, support legs 513 and safety lifts 514 may also be provided.

Figure 17:
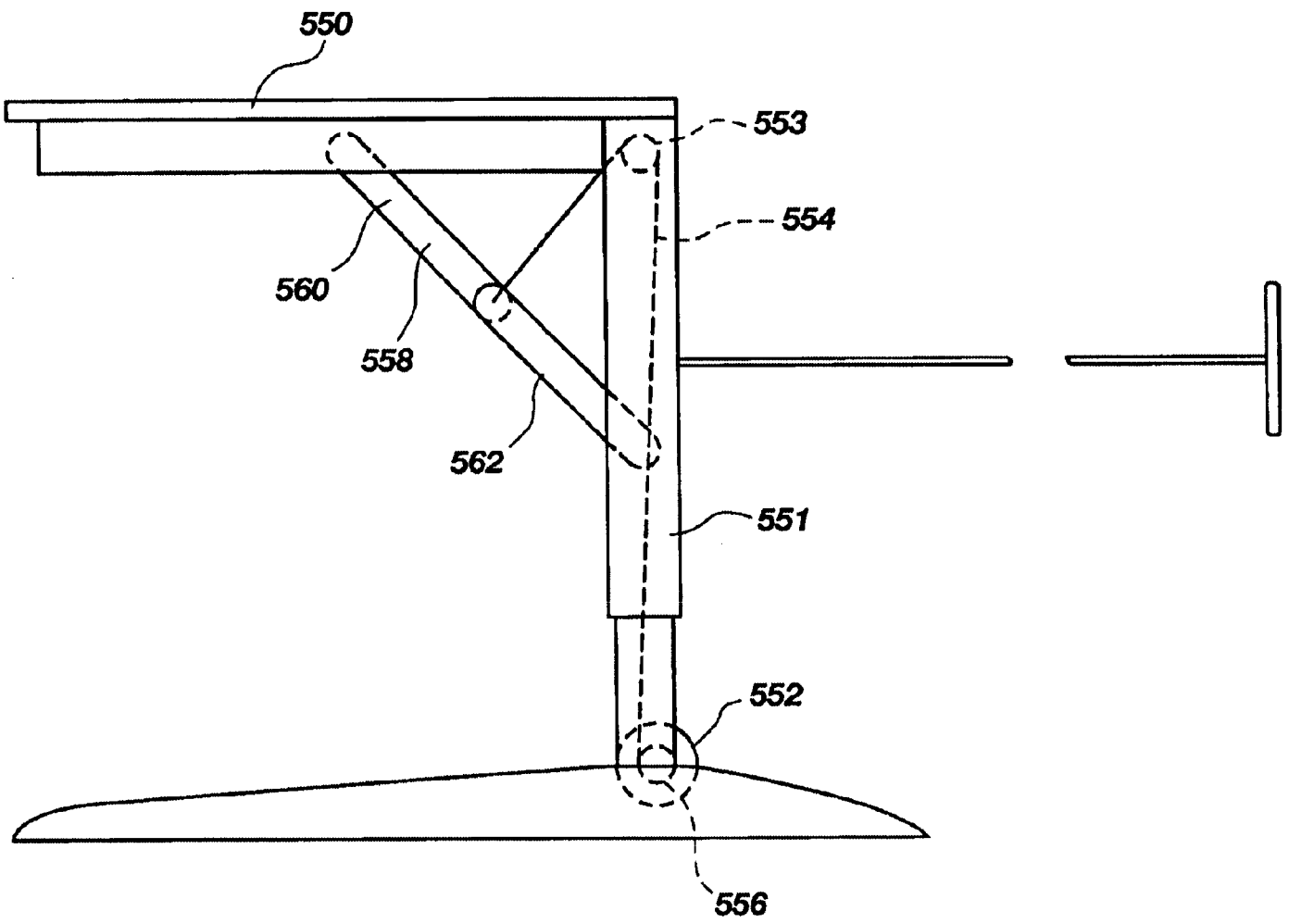
FIG. 17 is a side view of a seventh embodiment of a bedside lower extremity lifting apparatus in a raised position in accordance with the principles of the present invention.
Figure 18:
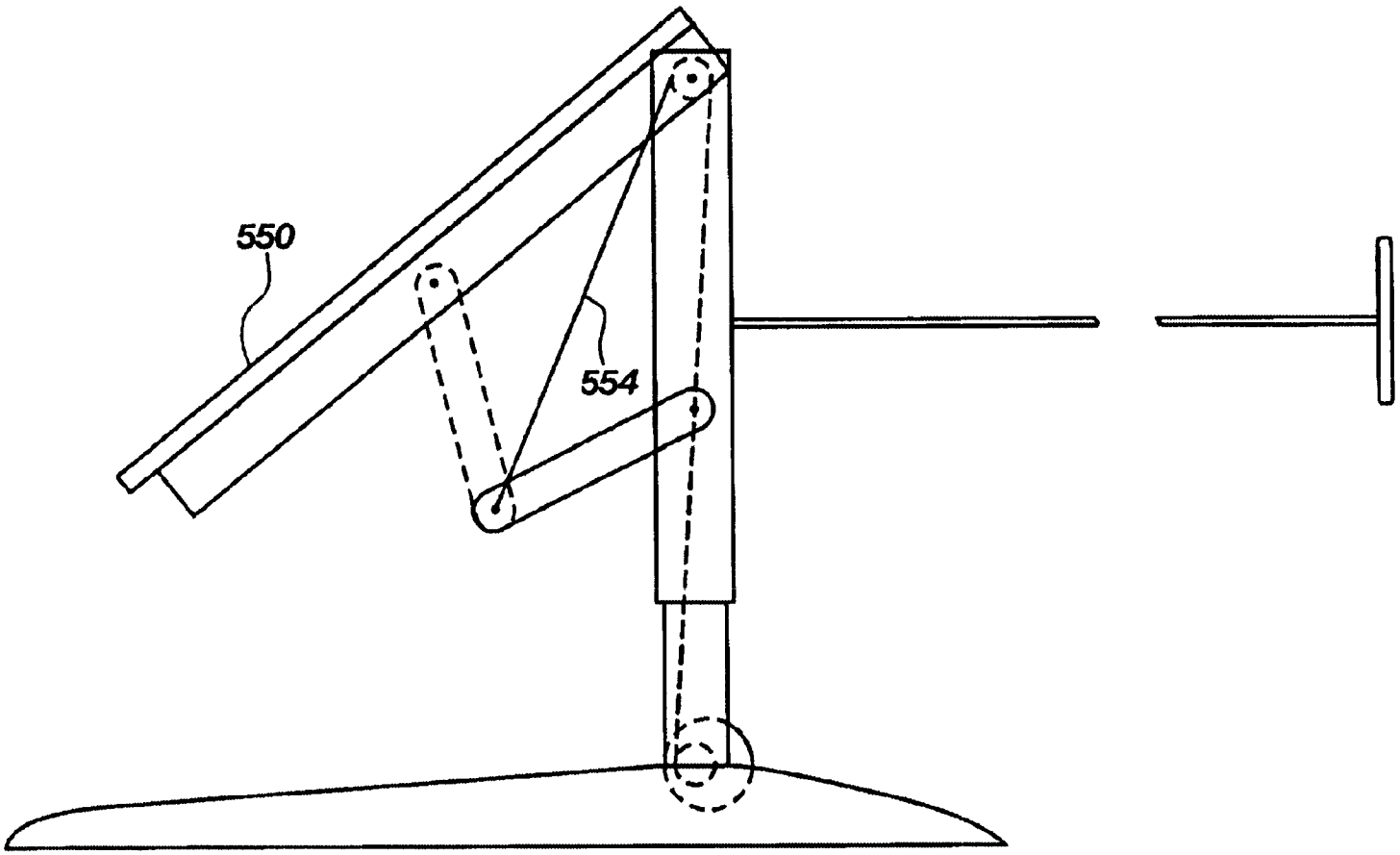
FIG. 18 is a side view of the bedside lower extremity lifting apparatus of FIG. 17 in a partially lowered position.

As shown in FIG. 17, the platform 550 can be raised and lowered with a cable and pulley assembly coupled to and driven by a motor 552. The cable 554 is coupled between a spindle 556 on the motor 552, over a pulley 553 and a folding lever arm 558. The lever arm 558 is comprised of a pair of elongate members 560 and 562 that are pulled to a position where the members 560 and 562 are in longitudinal alignment in order to raise the platform 550. The lever arm 558 is rotatably attached between the platform 550 and the upright frame portion 551. As shown in FIG. 18, as the tension on the cable is released, the members 560 and 562 can fold at the joint between them allowing the platform to pivot downwardly. Thus, the weight of the platform is caused by gravity to retract and is lifted by the cable pulley system to its upright position.

Figure 19:
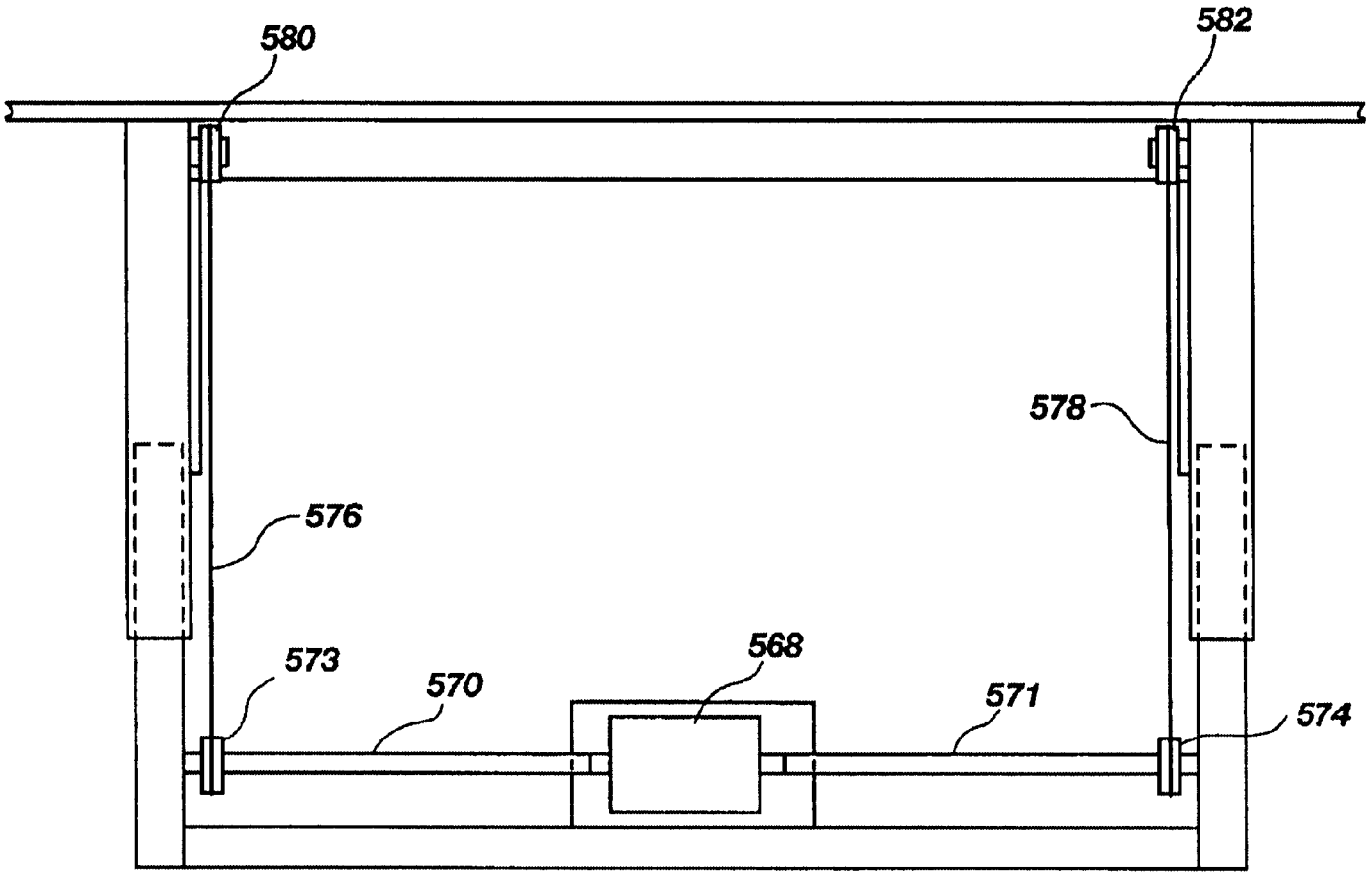
FIG. 19 is a back view of the bedside lower extremity lifting apparatus of FIG. 17.

As illustrated in FIG. 19, a motor 568 may be centrally located with drive shafts 570 and 571 driving base spindles 573 and 574. Cables 576 and 578 then extend over idler pulleys 580 and 582 to terminate at the lever arms for raising the platform.

Figure 20:
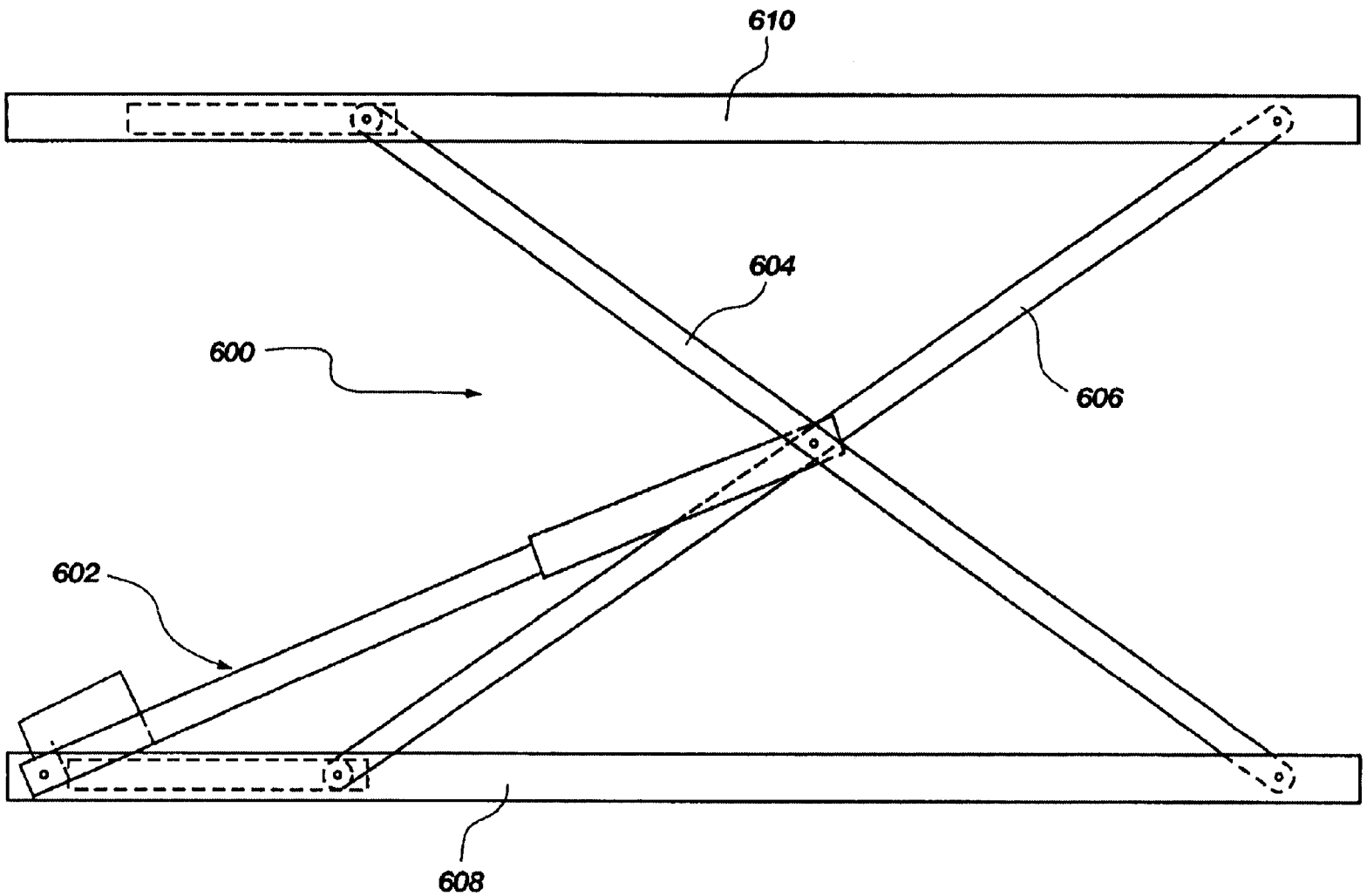
FIG. 20 is a side view of an eighth embodiment of a bedside lower extremity lifting apparatus in a raised position in accordance with the principles of the present invention.

As shown in FIG. 20, a platform lifting apparatus, generally indicated at 600 is illustrated. The device is comprised of a ram assembly 602 which engages with a pair of scissor-type frame members 604 and 606 at the point of intersection of the members 604 and 606. The members 604 and 606 are pivotally connected to and between a base portion 608 and a platform 610. At one end of each frame member 604 and 606, the pivot points are fixed. At the other ends, the pivot points can translate relative to the base portion 608 and platform 610, respectively. As the ram assembly 602 is extended, the platform 610 is lifted and subsequently lowered upon retraction of the ram. By providing two or more spaced apart sets of frame members 604 and 606, the platform 610 can be properly supported relative to the base 608. In this embodiment, the platform 610 maintains a horizontal position relative to the base portion 608 throughout the lifting or lowering operation.

Figure 21:
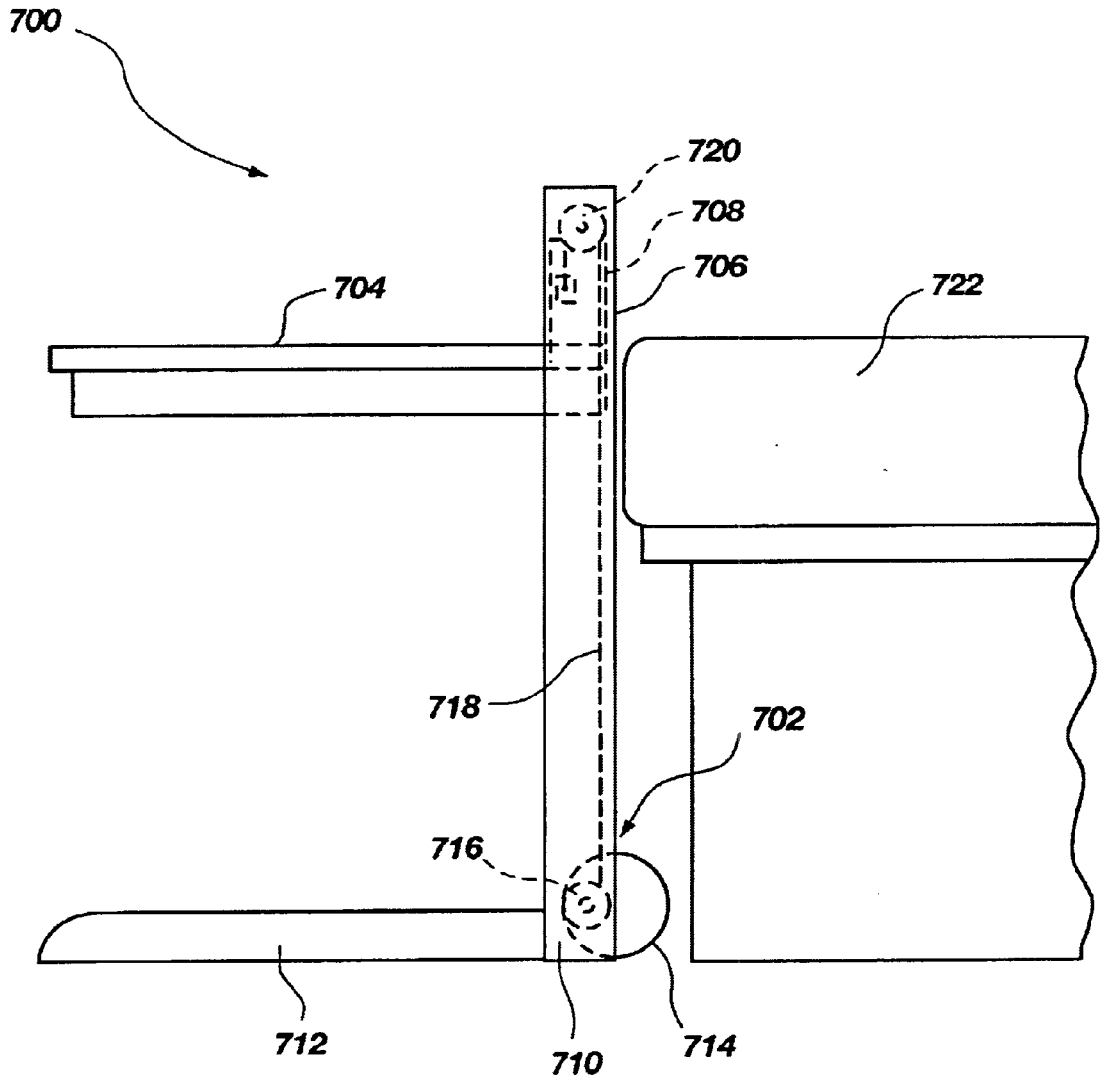
FIG. 21 is a side view of a ninth embodiment of a bedside lower extremity lifting apparatus in a raised position in accordance with the principles of the present invention.

Finally, as shown in FIG. 21, another platform lifting apparatus, generally indicated at 700 is illustrated. The device is comprised of a cable/pulley assembly 702 that is capable of raising a platform 704. The platform 704 moves vertically relative to an upright support structure 706 but does not pivot relative thereto as described with reference to other embodiments herein described. The upright support 706 may comprise a square tube, a C-shaped member or a housing that spans the entire width of the platform 704. The upright support 706 at least partially houses a platform support member 708 configured to slide within the tube. The platform support member 708 is secured relative to the platform and is generally oriented at a 90 degree angle to the top surface of the platform 704. Thus, the upright support 706 maintains the vertical orientation of the support member 708 with the platform forming a cantilever that extends from the upright support 706. The upright support 706 is mounted at its lower end 710 to a base support leg or platform 712. A mirror image of the upright support 706, support member 708 and base 712 is provided on the opposite side of the platform 704.

A motor 714 is mounted relative to the lower end 710 of the upright support 706 and is coupled to a spindle 716. The spindle 716 drives a cable 718 that extends from the spindle 716 to the top of the device 700 over an idler 720 and is attached at one end to the upright support 706. As the cable 718 is wound around the spindle 716, tension is applied to the cable 718 to lift the upright support 706 and thus the platform 704. As the cable 718 is unwound from the spindle 716 by the motor 714, the weight of the platform 704 will cause the platform to lower accordingly. Of course, the cable/pulley assembly could be substituted with a chain/gear assembly or a ram system. By abutting the back of the upright support 706 against a bed or patient table 722, the device 700 is self supporting with the legs 712 extending below the platform 704. Rearward tipping of the device is prevented by the table 722. Of course, rearwardly extending legs may also be employed if the situation allows.

While the method and apparatus of the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. For example, various other mechanical devices, such as belts, pulleys, gears, pneumatic cylinders, and the like may be employed to accomplish the features of the present invention. The claims provided herein are intended to cover such modifications and combinations and all equivalents thereof. Reference herein to specific details of the illustrated embodiments is by way of example and not by way of limitation.

What is claimed is:

1. An apparatus for lifting the lower extremities of a person, comprising;

a support frame configured for placing next to an elevated, substantially horizontal surface, said support frame comprising a base portion attached to an upright portion;

a platform coupled to the support frame, the platform having a surface area sufficient for supporting at least one leg of a user while being lifted or lowered by the platform, the support frame and platform configured to allow a user to sit on the edge of an elevated, substantially horizontal surface while actuating the platform from a first lower position to a second elevated position; and an actuator assembly coupled between the support frame and the platform for raising the platform from the first position to the second position to allow a user to more easily maneuver at least one leg onto the elevated, substantially horizontal surface;

whereby said base portion is configured to extend beneath a bed frame and further including at least one bracket for coupling the base portion to the bed frame.

2. The apparatus of claim 1, wherein said platform is hingedly coupled relative to said support frame.

3. The apparatus of claim 2, wherein the platform is positioned between the legs of the user and the elevated, substantially horizontal surface.

4. The apparatus of claim 1, further including a second bracket coupled to the upright portion of the frame for attaching the upright portion to the frame of the bed.

5. The apparatus of claim 1, wherein said base portion and said upright portion are oriented at approximately ninety degrees to one another.

6. The apparatus of claim 1, wherein said support frame comprises an upright portion vertically supported by a base assembly, said base assembly comprising at least one base member outwardly extending from said upright portion so as to be positioned below said platform upon raising of said platform.

7. The apparatus of claim 6, wherein said base member further comprises at least one rearwardly extending member coupled to said upright portion for supporting said upright portion.

8. The apparatus of claim 2, further comprising at least one extendable leg coupled to said support frame for extending below said platform when said platform is at least partially pivoted from a substantially vertical position.

9. The apparatus of claim 8, wherein said at least one extendable leg comprises a pair of legs coupled to said support frame moveable from a first position to a second position wherein said pair of legs move from said first position to said second position as said platform moves from said substantially vertical position to said substantially horizontal position.

10. The apparatus of claim 1, wherein said platform has a first lateral edge and a second lateral edge, said first lateral edge being supported by said support frame at a height approximately the height of the elevated, substantially horizontal surface.

11. The apparatus of claim 10, wherein said height is below the top surface of a top mattress of the bed to allow a user to sit on an edge of the top mattress with the platform in its lowered position positioned between the top mattress and the leg or legs of the user.

12. The apparatus of claim 1, wherein said upright portion is comprised of at least one first elongate member and at least one second elongate member substantially axially aligned and adjustable relative to one another so as to provide adjustability of the length of the upright portion.

13. The apparatus of claim 1, wherein said actuator assembly is comprised of a selectively extendable ram coupled between said base portion and said platform.

14. The apparatus of claim 13, further comprising a ram extension lever coupled between said ram and said platform.

15. The apparatus of claim 13, further comprising a wheel assembly coupled to the ram and a track for receiving and guiding said wheel along a substantially horizontal path along a first portion thereof and along an inclined path along a second portion thereof.

16. The apparatus of claim 15, wherein said upright portion comprises a pair of telescopic members for adjusting the height of the edge of the platform positioned nearest the bed or patient table, and further including an arm pivotally attached to one of said telescopic members and configured for movement with said wheel along at least a portion of said inclined path so as to raise said edge as said platform is raised.

17. The apparatus of claim 1, wherein said actuator assembly is configured to be positioned beneath the elevated, substantially horizontal surface.

18. The apparatus of claim 17, wherein said actuator assembly comprises a rack and pinion assembly.

19. The apparatus of claim 18, wherein said rack remains stationary and said pinion is translatable along said rack, and further including an extension lever coupled between said platform and said pinion whereby movement of said pinion causes selective raising and lowering of said platform.

20. The apparatus of claim 1, further including a user control electronically connected to said actuator assembly configured for allowing a user to selectively raise said platform.

21. The apparatus of claim 1, wherein said actuator assembly comprises a cable and pulley assembly coupled to a pair of folding arms connected between said upright portion and said platform, whereby applying tension to the cable causes the pair of folding arms to straighten and raise the platform accordingly.

22. The apparatus of claim 1, further including a tether attached to said support frame and configured for attaching relative to said elevated, substantially horizontal surface.

23. The apparatus of claim 22, wherein said tether further comprises a T-shaped member for positioning between the mattresses of a bed and abutting against the side of the bed opposite the support frame with the tether extending from the support frame to the T-shaped member and positioned between the mattresses.

24. The apparatus of claim 1, wherein said platform is raised and lowered in a substantially horizontal position relative to said support frame.

25. A method of lifting the lower extremities of a person onto an elevated, substantially horizontal surface, comprising:

positioning a lifting apparatus adjacent the side of an elevated, substantially horizontal surface, the lifting apparatus comprising a support frame, a platform coupled to the support frame and an actuator assembly coupled between the support frame and the platform for raising the platform from a first position to a second elevated position;

having a user sit on an edge of the elevated horizontal surface so that the platform is positioned below the torso of the user;

raising the platform from the first position to the second position thereby lifting at least one leg of the user; and having the user maneuver their at least one leg from the support platform to the elevated surface.

26. The method of claim 25, wherein said elevated surface comprises at least one mattress and further including compressing said at least one mattress by sitting on an edge thereof proximate said platform.

27. The method of claim 26, wherein said compressing includes compressing said at least one mattress to a height approximately the height of a side of said platform proximate said at least one mattress.

28. The method of claim 25, further including providing a handheld control device and selectively raising and lowering said platform with said handheld control device.

29. The method of claim 26, further including maintaining said platform in said second position until said handheld unit is employed to lower said platform.

30. The method of claim 25, further including raising the platform to said second position, maneuvering said at least one leg from the elevated surface to the platform and selectively lowering the leg with the platform.

31. The method of claim 25, further comprising selectively lowering said platform to a substantially vertical position.

32. The method of claim 25, wherein said raising the platform from the first position to the second position comprises moving said platform from a substantially vertical position to a sufficiently horizontal position.

33. The method of claim 25, wherein said raising the platform from the first position to the second position comprises maintaining the platform in a sufficiently horizontal position throughout said raising.

34. The method of claim 25, further comprising mounting said support frame to the frame of a bed.

35. An apparatus for lifting the lower extremities of a person, comprising;

a support frame configured for placing next to a bed;

a platform coupled to the support frame, the platform configured for supporting at least one leg of a user while being lifted or lowered by the platform, the support frame and platform configured to allow a user to sit on the edge of the bed while actuating the platform from a first lower position to a second elevated position, said platform having a first lateral edge and a second lateral edge, said first lateral edge being supported by said support frame at a height below the top surface of a top mattress of the bed to allow a user to sit on an edge of the top mattress with the platform in its lowered position positioned between the top mattress and the leg or legs of the user; and an actuator assembly coupled between the support frame and the platform for raising the platform from the first position to the second position to allow a user to more easily maneuver at least one leg onto the bed.

36. The apparatus of claim 35, wherein said support frame comprises a base portion attached to an upright portion.

37. The apparatus of claim 36, wherein said base portion is configured to extend beneath a bed frame and further including at least one bracket for coupling the base portion to the bed frame.

38. The apparatus of claim 37, further including a second bracket coupled to the upright portion of the frame for attaching the upright portion to the frame of the bed.

39. The apparatus of claim 35, further comprising at least one extendable leg coupled to said support frame for laterally extending below said platform when said platform is at least partially pivoted from a substantially vertical position.

40. The apparatus of claim 39, wherein said at least one extendable leg comprises a pair of legs coupled to said support frame moveable from a first horizontal position to a second horizontal position wherein said pair of legs move from said first horizontal position to said second horizontal position as said platform moves from said substantially vertical position to said substantially horizontal position.

41. The apparatus of claim 36, wherein said upright portion is comprised of at least one first elongate member and at least one second elongate member substantially axially aligned and adjustable relative to one another so as to provide adjustability of the length of the upright portion.

42. The apparatus of claim 35, further including a tether attached to said support frame and configured for attaching relative to said bed.

43. The apparatus of claim 42, wherein said tether further comprises a T-shaped member for positioning between the mattresses of a bed and abutting against the side of the bed opposite the support frame with the tether extending from the support frame to the T-shaped member and positioned between the mattresses.

44. The apparatus of claim 35, wherein said platform is raised and lowered in a substantially horizontal position relative to said support frame.

45. An apparatus for lifting the lower extremities of a person, comprising;

a support frame configured for placing next to an elevated, substantially horizontal surface;

a platform having a first edge and a second edge, said platform being pivotally coupled relative to said support frame for rotation about a substantially horizontal axis proximate said first edge and having a surface area sufficient for supporting at least one leg of a user while being lifted or lowered by the platform; and an actuator assembly coupled between the support frame and the platform for pivoting the platform in a relatively controlled manner to move said second edge between a lower position and a raised position, said platform being substantially horizontal when said second edge is in said raised position, thereby allowing a user to more easily maneuver at least one leg onto and off of the elevated, substantially horizontal surface.

46. The apparatus of claim 45, wherein said first edge has a height that allows a user to sit on the edge of the elevated, substantially horizontal surface while moving the second edge from the lower position to the raised position.

47. The apparatus of claim 45, wherein said support frame extends below said platform when said platform is in a substantially horizontal position to prevent obstruction of movement of a user's leg or legs.

48. The apparatus of claim 45, further comprising at least one bracket for coupling the support frame to the elevated, substantially horizontal surface.

49. The apparatus of claim 45, wherein said support frame comprises an upright portion and at least one laterally extendable leg coupled to said upright portion for laterally extending below said platform when said second edge is pivoted from the lower position to the raised position, the at least one laterally extendable leg extending a distance to be approximately vertically aligned with said second edge of said platform.

50. The apparatus of claim 45, wherein a height of said first edge is below a top surface of a top mattress of a bed to allow a user to sit on an edge of the top mattress with the second edge of the platform in the lowered position and the platform positioned between the top mattress and the leg or legs of the user.

51. The apparatus of claim 45, wherein said support frame is comprised of at least one first elongate member and at least one second elongate member and adjustable relative to one another so as to provide adjustability of the height of the platform.

52. The apparatus of claim 45, wherein said actuator assembly is comprised of a selectively extendable ram coupled between said support frame and said platform.

53. The apparatus of claim 52, further comprising a ram extension lever coupled between said ram and said platform.

54. The apparatus of claim 52, further comprising a wheel assembly coupled to the ram and a track for receiving and guiding said wheel along a substantially horizontal path along a first portion thereof and along an inclined path along a second portion thereof.

55. The apparatus of claim 54, wherein said support platform comprises a pair of telescopic members for adjusting the height of the edge of the platform positioned nearest the elevated, substantially horizontal surface, and further including an arm pivotally attached to one of said telescopic members and configured for movement with said wheel along at least a portion of said inclined path so as to raise said edge as said platform is raised.

56. The apparatus of claim 45, wherein said actuator assembly comprises a rack and pinion assembly, and wherein said rack remains stationary and said pinion is translatable along said rack, and further including an extension lever coupled between said platform and said pinion whereby movement of said pinion causes selective raising and lowering of said platform.

57. The apparatus of claim 45, wherein said actuator assembly comprises a cable and pulley assembly coupled to a pair of folding arms connected between said support frame and said platform, whereby applying tension to the cable causes the pair of folding arms to straighten and raise the platform accordingly.

58. The apparatus of claim 45, further including a tether attached to said support frame and configured for attaching relative to said elevated, substantially horizontal surface.

59. The apparatus of claim 58, wherein said tether further comprises a T-shaped member for positioning between the mattresses of a bed and abutting against the side of the bed opposite the support frame with the tether extending from the support frame to the T-shaped member and positioned between the mattresses.

60. An apparatus for lifting the lower extremities of a person, comprising;

a support frame configured for placing next to an elevated, substantially horizontal surface;

a platform coupled to the support frame, the platform having a surface area sufficient for supporting at least one leg of a user while being lifted or lowered by the platform, the support frame and platform configured to allow a user to sit on the edge of an elevated, substantially horizontal surface while actuating the platform from a first lower position to a second elevated position;

an actuator assembly coupled between the support frame and the platform for raising the platform from the first position to the second position to allow a user to more easily maneuver at least one leg onto the elevated, substantially horizontal surface; and a tether attached to said support frame and configured for attaching relative to said elevated, substantially horizontal surface.

61. The apparatus of claim 60, wherein said platform is hingedly coupled relative to said support frame.

62. The apparatus of claim 60, wherein the platform is positioned between the legs of the user and the elevated, substantially horizontal surface.

63. The apparatus of claim 60, wherein said support frame comprises a base portion attached to an upright portion.

64. The apparatus of claim 63, wherein said base portion is configured to extend beneath a bed frame and further including at least one bracket for coupling the base portion to the bed frame.

65. The apparatus of claim 64, further including a second bracket coupled to the upright portion of the frame for attaching the upright portion to the frame of the bed.

66. The apparatus of claim 63, wherein said base portion and said upright portion are oriented at approximately ninety degrees to one another.

67. The apparatus of claim 60, wherein said support frame comprises an upright portion vertically supported by a base assembly, said base assembly comprising at least one base member outwardly extending from said upright portion so as to be positioned below said platform upon raising of said platform.

68. The apparatus of claim 67, wherein said base member further comprises at least one rearwardly extending member coupled to said upright portion for supporting said upright portion.

69. The apparatus of claim 60, further comprising at least one extendable leg coupled to said support frame for extending below said platform when said platform is at least partially pivoted from a substantially vertical position.

70. The apparatus of claim 69, wherein said at least one extendable leg comprises a pair of legs coupled to said support frame moveable from a first position to a second position wherein said pair of legs move from said first position to said second position as said platform moves from said substantially vertical position to said substantially horizontal position.

71. The apparatus of claim 60, wherein said platform has a first lateral edge and a second lateral edge, said first lateral edge being supported by said support frame at a height approximately the height of the elevated, substantially horizontal surface.

72. The apparatus of claim 71, wherein said height is below the top surface of a top mattress of the bed to allow a user to sit on an edge of the top mattress with the platform in its lowered position positioned between the top mattress and the leg or legs of the user.

73. The apparatus of claim 63, wherein said upright portion is comprised of at least one first elongate member and at least one second elongate member substantially axially aligned and adjustable relative to one another so as to provide adjustability of the length of the upright portion.

74. The apparatus of claim 63, wherein said actuator assembly is comprised of a selectively extendable ram coupled between said base portion and said platform.

75. The apparatus of claim 74, further comprising a ram extension lever coupled between said ram and said platform.

76. The apparatus of claim 74, further comprising a wheel assembly coupled to the ram and a track for receiving and guiding said wheel along a substantially horizontal path along a first portion thereof and along an inclined path along a second portion thereof.

77. The apparatus of claim 76, wherein said upright portion comprises a pair of telescopic members for adjusting the height of the edge of the platform positioned nearest the bed or patient table, and further including an arm pivotally attached to one of said telescopic members and configured for movement with said wheel along at least a portion of said inclined path so as to raise said edge as said platform is raised.

78. The apparatus of claim 60, wherein said actuator assembly is configured to be positioned beneath the elevated, substantially horizontal surface.

79. The apparatus of claim 78, wherein said actuator assembly comprises a rack and pinion assembly.

80. The apparatus of claim 79, wherein said rack remains stationary and said pinion is translatable along said rack, and further including an extension lever coupled between said platform and said pinion whereby movement of said pinion causes selective raising and lowering of said platform.

81. The apparatus of claim 60, further including a user control electronically connected to said actuator assembly configured for allowing a user to selectively raise said platform.

82. The apparatus of claim 63, wherein said actuator assembly comprises a cable and pulley assembly coupled to a pair of folding arms connected between said upright portion and said platform, whereby applying tension to the cable causes the pair of folding arms to straighten and raise the platform accordingly.

83. The apparatus of claim 60, wherein said tether further comprises a T-shaped member for positioning between the mattresses of a bed and abutting against the side of the bed opposite the support frame with the tether extending from the support frame to the T-shaped member and positioned between the mattresses.

84. The apparatus of claim 60, wherein said platform is raised and lowered in a substantially horizontal position relative to said support frame.

* * * * *